US010633897B2

(12) United States Patent
Liang et al.

(10) Patent No.: US 10,633,897 B2
(45) Date of Patent: Apr. 28, 2020

(54) TAMPER-RESISTANT LOCK

(71) Applicant: Vision Industries Group, Inc., So. Plainfield, NJ (US)

(72) Inventors: Luke Liang, So. Plainfield, NJ (US); Tong Liang, Guangzhou (CN); David Chen, Guangzhou (CN); Troy A. Kirkland, Altoona, PA (US)

(73) Assignee: Vision Industries Group, Inc., So. Plainfield, NJ (US)

( * ) Notice: Subject to any disclaimer, the term of this patent is extended or adjusted under 35 U.S.C. 154(b) by 528 days.

(21) Appl. No.: 15/434,371

(22) Filed: Feb. 16, 2017

(65) Prior Publication Data

US 2018/0230710 A1 Aug. 16, 2018

(51) Int. Cl.
*E05C 3/04* (2006.01)
*E05B 9/02* (2006.01)
(Continued)

(52) U.S. Cl.
CPC ..... *E05C 3/046* (2013.01); *E05B 9/02* (2013.01); *E05B 17/2038* (2013.01);
(Continued)

(58) Field of Classification Search
CPC ..... E05C 3/045; E05C 3/046; E05C 15/0053; E05C 3/04; E05C 2007/007; Y10T 292/0864; Y10T 292/1028; Y10T 292/1043; Y10T 292/1083; Y10T 292/1089; Y10T 292/1039; Y10T 292/1041; Y10T 292/104; E05B 3/10;
(Continued)

(56) References Cited

U.S. PATENT DOCUMENTS 36,524 A 9/1862 Minor
51,222 A 11/1865 Ridell
(Continued)

FOREIGN PATENT DOCUMENTS

GB 2 286 627 8/1995
GB 2 461 079 12/2009
(Continued)

*Primary Examiner* — Carlos Lugo
*Assistant Examiner* — Faria F Ahmad
(74) *Attorney, Agent, or Firm* — Thomas A. O'Rourke; Bodner & O'Rourke, LLP

(57) ABSTRACT

A tamper-proof lock includes: a housing, shaft/handle, cam, lever, spring, and plate. The shaft is pivotally mounted in a housing orifice, with the cam pivotally mounted to the shaft. The cam has first and second shaped openings at first and second respective radial positions, and an arcuate recess. The lever is secured to the shaft, and has a protrusion that alternately engages each of first and second ends of the arcuate recess to respectively/selectively drive the cam to rotate/counter-rotate in first and second directions, into locked and unlocked cam positions. The spring biases the plate for a protrusion thereon to be respectively received within each of first and second shaped cam openings, when aligned therewith at those cam positions, and for a curved surface of the plate to be correspondingly received within first and second curved cam recesses, respectively, when aligned therewith, which facilitate withdrawal of the plate protrusion.

8 Claims, 30 Drawing Sheets

(51) Int. Cl.

| | |
|---|---|
| ***E05B 65/08*** | (2006.01) |
| ***E05B 17/20*** | (2006.01) |
| ***E05C 7/00*** | (2006.01) |
| ***E05B 3/10*** | (2006.01) |
| ***E05B 15/00*** | (2006.01) |

(52) U.S. Cl.
CPC ..... *E05B 65/0841* (2013.01); *E05B 3/10* (2013.01); *E05B 15/004* (2013.01); *E05B 15/0053* (2013.01); *E05B 17/2019* (2013.01); *E05C 3/04* (2013.01); *E05C 3/045* (2013.01); *E05C 2007/007* (2013.01); *Y10T 292/0864* (2015.04); *Y10T 292/104* (2015.04); *Y10T 292/1028* (2015.04); *Y10T 292/1039* (2015.04); *Y10T 292/1041* (2015.04); *Y10T 292/1043* (2015.04); *Y10T 292/1083* (2015.04); *Y10T 292/1089* (2015.04)

(58) Field of Classification Search
CPC ..... E05B 15/004; E05B 17/2019; E05B 9/02; E05B 17/2038; E05B 65/0841
USPC ..... 292/DIG. 20, DIG. 47
See application file for complete search history.

(56) References Cited

U.S. PATENT DOCUMENTS 108,778 A 11/1870 Gorman
115,781 A 6/1871 Steele
126,872 A 5/1872 Buckman
148,857 A 3/1874 Smith
166,842 A 8/1875 Berryman
178,360 A 6/1876 Cooper
192,614 A 7/1877 Andrews
192,919 A 7/1877 Hoyt
201,146 A 3/1878 Adler
215,125 A 5/1879 Hunter
226,033 A 3/1880 Burns
230,476 A 7/1880 Green
234,387 A 11/1880 Burgess
284,993 A 9/1883 Abele
314,350 A 3/1885 Smith
316,285 A 4/1885 McKeen
331,005 A 11/1885 Sahr
336,302 A 2/1886 Dudgeon
346,788 A 8/1886 Teufel
350,678 A 10/1886 Hussey
353,287 A 11/1886 Chumard
369,885 A 9/1887 Shaw
375,656 A 12/1887 Shaw
376,252 A 1/1888 McIntyre
379,910 A 3/1888 Rosentreter
410,728 A 9/1889 Brown
417,868 A 12/1889 Janes
423,761 A 3/1890 Hasenpflug
452,723 A 5/1891 Schmalhausen
480,148 A 8/1892 Theby
493,159 A 3/1893 Gibson
509,941 A 12/1893 Perry
512,593 A 1/1894 Webster
520,754 A 5/1894 Burmeister
526,118 A 9/1894 Sharp
528,656 A 11/1894 Burmeister
530,078 A 12/1894 Ammerman
534,185 A 2/1895 Winchester
537,258 A 4/1895 Wilcox
539,030 A 5/1895 Bitner
551,181 A 12/1895 Dillon
551,242 A 12/1895 Wallace
554,448 A 2/1896 Keil
564,426 A 7/1896 Hubbard
587,424 A 8/1897 Bonine
590,225 A 9/1897 Hill
653,458 A 7/1900 Paquette
683,928 A 10/1901 Geraghty
688,491 A 12/1901 Sigler
695,736 A 3/1902 Kendrick
699,696 A 5/1902 Mellen
708,406 A 9/1902 Robison
714,343 A 11/1902 Wellman
718,007 A 1/1903 Linn
719,981 A 2/1903 Adams
722,162 A 3/1903 St. Louis
724,466 A 4/1903 Hannan
743,716 A 11/1903 Hadka
744,755 A 11/1903 Hasenpflug
745,755 A 12/1903 McElwee
756,453 A 4/1904 Arens
756,559 A 4/1904 Arens
757,249 A 4/1904 Barnard
759,642 A 5/1904 Sparks
764,493 A 7/1904 Noseworthy
769,386 A 9/1904 Johnson
769,767 A 9/1904 Phelps
774,536 A 11/1904 Saunders
775,602 A 11/1904 Heamshaw
800,043 A 9/1905 Witte
804,994 A 11/1905 Andrews
815,537 A 3/1906 Kissinger
833,900 A 10/1906 Sigler
837,811 A 12/1906 Ebbeson
840,427 A 1/1907 Brister
865,090 A 9/1907 Eddy
866,073 A 9/1907 Saunders
878,206 A 2/1908 Johnson
881,658 A 3/1908 Bowman
886,108 A 4/1908 Allen
887,690 A 5/1908 Pearce
922,894 A 5/1908 Heid
897,719 A 9/1908 Daubaignan
900,079 A 10/1908 Bittorf
910,850 A 1/1909 Petrie
926,899 A 7/1909 Roy
928,408 A 7/1909 Taube
948,628 A 2/1910 Jefferis
959,150 A 5/1910 Morris
966,063 A 8/1910 Toothaker
976,777 A 11/1910 Brown
980,131 A 12/1910 Shean
998,642 A 7/1911 Shean
1,003,386 A 9/1911 Walker
1,006,211 A 10/1911 Hermon
1,020,454 A 3/1912 Seidenbecker
1,041,803 A 10/1912 Kilburn
1,051,918 A 2/1913 Rowley
1,059,939 A 4/1913 James
1,069,079 A 7/1913 Voight
1,077,487 A 11/1913 Miller
1,080,172 A 12/1913 Rusk
1,100,820 A 6/1914 Edwards
1,121,228 A 12/1914 Burkhart
1,122,026 A 12/1914 O'Rourke
1,127,835 A 2/1915 Wastlund
1,133,217 A 3/1915 Barton
1,141,437 A 6/1915 Unterlender
1,148,712 A 8/1915 Overland
1,163,086 A 12/1915 Harper
1,173,129 A 2/1916 Taliaferro
1,177,637 A 4/1916 Lane
1,177,838 A 4/1916 Wilkinson
1,207,989 A 12/1916 O'Rourke
1,232,683 A 7/1917 Hollis
1,243,115 A 10/1917 Shur
1,247,182 A 11/1917 Tuekmantel
1,253,810 A 1/1918 Gianninoto
1,261,274 A 4/1918 Newsam
1,269,467 A 6/1918 Winters
1,270,740 A 6/1918 Keyes
1,272,900 A 7/1918 Berman
1,279,353 A 9/1918 Kelley
1,311,052 A 7/1919 Danforth
1,322,677 A 11/1919 Ditlefsen
1,338,250 A 4/1920 Parkes

(56) References Cited

U.S. PATENT DOCUMENTS 1,338,416 A 4/1920 Bellinger
1,339,362 A 5/1920 L'Heureux
1,341,234 A 5/1920 Horton
1,350,698 A 8/1920 Boedtcher
1,387,302 A 8/1921 Page
1,388,272 A 8/1921 Lawrence
1,393,628 A 10/1921 Leichter
1,398,174 A 11/1921 Carlson
1,399,897 A 12/1921 Singer
1,412,154 A 4/1922 Wollesen
1,439,585 A 12/1922 Trost
1,461,467 A 7/1923 Stuart
1,463,866 A 8/1923 Bourbeau
1,485,382 A 3/1924 Foley
1,490,874 A 4/1924 Webb
1,516,995 A 11/1924 Trigueiro
1,550,532 A 8/1925 French
1,552,690 A 9/1925 Frantz
1,587,037 A 6/1926 Rudolph
1,601,051 A 9/1926 Wilbert
1,605,717 A 11/1926 Gregg
1,619,031 A 3/1927 Ostrosky
1,622,742 A 3/1927 Shipman
1,658,818 A 1/1928 Dillon
1,692,579 A 11/1928 Schrader
1,704,946 A 3/1929 Lindgren
1,712,792 A 5/1929 Hansen
1,715,957 A 6/1929 Stein
1,724,637 A 8/1929 Bergstrom
1,750,715 A 3/1930 Jeffers
1,794,171 A 2/1931 Grutel
1,812,288 A 6/1931 Drapeau
1,819,824 A 8/1931 McAllister
1,864,253 A 6/1932 McIntyre
1,869,274 A 7/1932 Phillips
1,891,940 A 12/1932 McAllister
1,900,936 A 3/1933 Huttger
1,901,974 A 3/1933 Macy
1,922,062 A 8/1933 Sullivan
1,960,034 A 5/1934 Stewart
1,964,114 A 6/1934 Gerlach
2,095,057 A 10/1937 Corrado
2,122,661 A 7/1938 Rightmyer
2,126,995 A 8/1938 Kingdon
2,136,408 A 11/1938 Bedell
2,158,260 A 5/1939 Stillman
2,202,561 A 5/1940 Lahiere
2,272,145 A 2/1942 Anderson
2,326,084 A 8/1943 Westrope
2,369,584 A 2/1945 Lundholm
2,452,521 A 10/1948 Johnson
2,480,016 A 8/1949 Granberg
2,480,988 A 9/1949 Walton
2,500,349 A 3/1950 De Groote et al.
2,503,370 A 4/1950 Zanona
2,523,559 A 9/1950 Couture
2,527,278 A 10/1950 Schemansky
2,537,736 A 1/1951 Carlson
2,560,274 A 7/1951 Cantelo
2,590,624 A 3/1952 James
2,599,196 A 6/1952 Peremi
2,605,125 A 7/1952 Emerson
2,612,398 A 9/1952 Miller
2,613,526 A 10/1952 Holmsten
2,621,951 A 12/1952 Ostadal
2,645,515 A 7/1953 Thomas
2,648,967 A 8/1953 Holmsten
2,670,982 A 3/1954 Banham
2,692,789 A 10/1954 Rivard
2,758,862 A 8/1956 Endter
2,766,492 A 10/1956 Day
2,789,851 A 4/1957 Lickteig
2,818,919 A 1/1958 Sylvan
2,846,258 A 8/1958 Granberg
2,855,772 A 10/1958 Hillgren
2,884,276 A * 4/1959 Baptist ..... E05C 3/046 292/242
2,941,832 A 6/1960 Grossman
3,027,188 A 3/1962 Eichstadt
3,135,542 A 6/1964 Wilkenson
3,187,526 A 6/1965 Moler
3,267,613 A 8/1966 McQuiston
3,288,510 A 11/1966 Gough
3,352,586 A 11/1967 Hakanson
3,362,740 A 1/1968 Burns
3,422,575 A 1/1969 Armstrong
3,438,153 A 4/1969 Lemme
3,599,452 A 8/1971 Maruyama
3,600,019 A 8/1971 Toyota
3,642,315 A 2/1972 Alpern
3,645,573 A 2/1972 Strang
3,683,652 A 8/1972 Halopoff
3,706,467 A 12/1972 Martin
3,762,750 A 10/1973 Orr
3,811,718 A 5/1974 Bates
3,907,348 A 9/1975 Bates
3,919,808 A 11/1975 Simmons
3,927,906 A 12/1975 Mieras
4,054,308 A 10/1977 Prohaska
4,059,298 A 11/1977 van Klompenburg
4,063,766 A 12/1977 Granberg
4,068,871 A 1/1978 Mercer
4,095,827 A 6/1978 Stavenau
4,095,829 A 6/1978 Van Klompenburg
4,102,546 A 7/1978 Costello
4,151,682 A 5/1979 Schmidt
4,165,894 A 8/1979 Wojciechowski
4,223,930 A 9/1980 Costello
4,227,345 A 10/1980 Durham
4,235,465 A 11/1980 Costello
4,253,688 A 3/1981 Hosooka
4,261,602 A 4/1981 Anderson
4,274,666 A 6/1981 Peck
4,293,154 A 10/1981 Cassells
4,303,264 A 12/1981 Uehara
4,305,612 A 12/1981 Hunt
4,392,329 A 7/1983 Suzuki
4,429,910 A 2/1984 Anderson
4,470,277 A 9/1984 Uyeda
4,475,311 A 10/1984 Gibson
4,525,952 A 7/1985 Cunningham
4,580,366 A 4/1986 Hardy
4,587,759 A 5/1986 Gray
4,621,847 A 11/1986 Paulson
4,624,073 A 11/1986 Randall
4,639,021 A 1/1987 Hope
4,643,005 A 2/1987 Logas
4,736,972 A 4/1988 Mosch
4,801,164 A * 1/1989 Mosch ..... E05C 3/046 292/204
4,813,725 A 3/1989 Mosch
4,824,154 A 4/1989 Simpson
4,827,685 A 5/1989 Schmidt
4,893,849 A 1/1990 Schlack
4,922,658 A 5/1990 Coddens
4,949,506 A 8/1990 Durham
4,961,286 A 10/1990 Bezubic
4,991,886 A 2/1991 Nolte
5,042,855 A 8/1991 Bennett
5,072,464 A 12/1991 Draheim
5,076,015 A 12/1991 Manzalini
5,087,087 A 2/1992 Vetter
5,087,088 A 2/1992 Milam
5,090,750 A 2/1992 Lindqvist
5,090,754 A 2/1992 Thompson
5,110,165 A * 5/1992 Piltingsrud ..... E05C 3/046 292/242
5,127,685 A 7/1992 Dallaire
5,139,291 A 8/1992 Schultz
5,143,412 A 9/1992 Lindqvist
5,161,839 A * 11/1992 Piltingsrud ..... E05C 3/046 292/241
5,165,737 A 11/1992 Riegelman
5,183,310 A 2/1993 Shaughnessy

(56) References Cited

U.S. PATENT DOCUMENTS 5,219,193 A * 6/1993 Piltingsrud ..... E05B 13/002 292/106
5,244,238 A 9/1993 Lindqvist
5,248,174 A 9/1993 Matz
5,274,955 A 1/1994 Dallaire
5,341,752 A 8/1994 Hambleton
5,398,447 A 3/1995 Morse
5,437,484 A 8/1995 Yamada
5,448,857 A 9/1995 Stormo
5,452,925 A 9/1995 Huang
5,454,609 A 10/1995 Slocomb
5,560,149 A 10/1996 Lafevre
5,582,445 A 12/1996 Olsen
RE35,463 E 2/1997 Vetter
5,636,475 A 6/1997 Nidelkoff
5,688,000 A 11/1997 Dolman
5,715,631 A 2/1998 Kailian
5,741,032 A 4/1998 Chaput
5,778,602 A 7/1998 Johnson
5,791,700 A 8/1998 Biro
5,839,767 A 11/1998 Piltingsrud
5,901,499 A 5/1999 Delaske
5,901,501 A 5/1999 Fountaine
5,911,763 A 6/1999 Quesada
5,927,768 A 7/1999 Dallmann
5,970,656 A 10/1999 Maier
5,992,907 A 11/1999 Sheldon
6,000,735 A 12/1999 Jourdenais
6,086,121 A 7/2000 Buckland
6,116,665 A 9/2000 Subliskey
6,135,510 A 10/2000 Diginosa
6,139,071 A 10/2000 Hopper
6,142,541 A * 11/2000 Rotondi ..... E05C 3/046 292/241
6,155,615 A 12/2000 Schulz
6,176,041 B1 1/2001 Roberts
6,178,696 B1 1/2001 Liang
6,183,024 B1 2/2001 Schultz
6,209,931 B1 4/2001 Von Stoutenborough
6,217,087 B1 4/2001 Fuller
6,230,443 B1 5/2001 Schultz
6,279,265 B1 8/2001 Scannell
6,349,576 B2 2/2002 Subliskey
6,364,375 B1 4/2002 Szapucki
6,546,671 B2 * 4/2003 Mitchell ..... E05B 65/08 292/DIG. 20
6,565,133 B1 5/2003 Timothy
6,588,150 B1 7/2003 Wong
6,592,155 B1 7/2003 Lemley
6,601,270 B2 * 8/2003 Eckhardt ..... E05B 3/00 16/412
6,607,221 B1 8/2003 Elliott
6,631,931 B2 10/2003 Magnusson
6,634,683 B1 10/2003 Brannan
6,817,142 B2 11/2004 Marshik
6,848,728 B2 2/2005 Rotondi
6,871,885 B2 3/2005 Goldenberg
6,871,886 B2 3/2005 Coleman
6,877,784 B2 4/2005 Kelley
6,925,758 B2 8/2005 Petit
6,957,513 B2 10/2005 Pettit
6,983,963 B2 1/2006 Eslick
7,000,957 B2 2/2006 Lawrence
7,013,603 B2 3/2006 Eenigenburg
7,063,361 B1 6/2006 Lawrence
7,070,211 B2 7/2006 Polowinczak
7,070,215 B2 7/2006 Kelley
7,100,951 B2 9/2006 Jien
7,147,255 B2 12/2006 Goldenberg
7,159,908 B2 * 1/2007 Liang ..... E05B 17/208 292/240
7,296,831 B2 11/2007 Generowicz
7,322,620 B1 * 1/2008 Lawrence ..... E05B 17/208 292/240
7,407,199 B2 * 8/2008 Richardson ..... E05B 63/20 292/163
7,481,470 B2 1/2009 Eenigenburg
7,510,221 B2 3/2009 Eenigenburg
7,591,494 B2 * 9/2009 Mitchell ..... E05B 63/185 292/336
7,607,262 B2 10/2009 Pettit
7,665,775 B1 2/2010 Miller
7,699,365 B2 * 4/2010 Liang ..... E05B 41/00 292/240
7,922,223 B2 * 4/2011 Lawrence ..... E05B 65/0841 292/241
7,963,577 B2 * 6/2011 Wolf ..... E05C 3/046 292/241
7,976,077 B2 7/2011 Flory
8,002,317 B2 * 8/2011 Satram ..... E05B 15/025 292/163
8,205,919 B2 6/2012 Flory
8,205,920 B2 6/2012 Flory
8,272,164 B2 9/2012 Albrecht
8,336,930 B2 * 12/2012 Liang ..... E05B 17/208 292/163
8,550,507 B2 10/2013 Barton
8,567,830 B2 * 10/2013 Liang ..... E05B 63/20 292/111
8,726,572 B2 5/2014 Derham
8,789,857 B2 * 7/2014 Liang ..... E05B 17/2019 292/111
8,789,862 B2 7/2014 Liang
8,844,985 B2 9/2014 Liang
9,140,033 B2 9/2015 Wolf
10,119,310 B2 * 11/2018 Liang ..... E05C 1/08
2006/0087130 A1 * 4/2006 Liang ..... E05B 17/208 292/242
2006/0192391 A1 8/2006 Pettit
2006/0244270 A1 11/2006 Rotondi
2007/0085350 A1 * 4/2007 Liang ..... E05B 41/00 292/240
2007/0205615 A1 * 9/2007 Eenigenburg ..... E05C 3/046 292/241
2008/0169658 A1 7/2008 Wolf
2010/0199726 A1 8/2010 Varney
2010/0218425 A1 9/2010 Nolte
2010/0263415 A1 10/2010 Ruspil
2011/0271720 A1 * 11/2011 Zheng ..... E05C 3/042 70/89
2011/0304163 A1 * 12/2011 Liang ..... E05B 63/20 292/242
2012/0313386 A1 * 12/2012 Liang ..... E05B 17/2019 292/224
2012/0313387 A1 * 12/2012 Liang ..... E05B 17/2019 292/224
2013/0214545 A1 8/2013 Wolf
2013/0283695 A1 10/2013 Hollerman
2014/0035297 A1 * 2/2014 Kreuser ..... E05C 3/004 292/202
2016/0076282 A1 3/2016 Wolf
2017/0152688 A1 * 6/2017 Liang ..... E05C 9/02

FOREIGN PATENT DOCUMENTS

GB 2 461 107 12/2009
GB 2 461 108 12/2009

* cited by examiner

TAMPER-RESISTANT LOCK

FIELD OF THE INVENTION

The present invention is directed to the field of window locks, and more particularly is directed to a sash window lock that is configured to be tamper-resistant.

BACKGROUND OF THE INVENTION

Single hung and double hung sliding windows are known in the art, and are often utilized in the construction of homes and other dwellings, and even offices. Sash locks are typically used to secure the lower sash window in a closed position, if the upper sash is not moveable, or may be used to secure both the upper and lower sash windows in a closed position, where both are slidable within a master window frame. Most sash locks are mounted to the meeting rail of the lower sash window, and use a rotatable cam that may engage a keeper in a locked position, which keeper may be attached to the upper sash window or to the master window frame.

The lock of the present invention is particularly configured for the cam, that locks and engages the keeper, to be tamper-resistant with respect to a person attempting to manipulate the cam from the exterior.

OBJECTS OF THE INVENTION

It is an object of the invention to provide a lock that is capable of locking the lower sash of a sliding sash window, or of locking both the upper sash and the lower sash window, where both sashes are slidable.

It is another object of the invention to provide a cam window lock capable of locking one or more sashes of a sliding sash window.

It is a further object of the invention to provide a latch for preventing the cam of the sash lock from being surreptitiously operated by an unauthorized party on the outside of the window.

Further objects and advantages of the invention will become apparent from the following description and claims, and from the accompanying drawings.

SUMMARY OF THE INVENTION

This Summary is provided to introduce a selection of concepts in a simplified form that are further described below in the Detailed Description. This Summary is not intended to identity key features or essential features of the claimed subject matter, nor is it intended to be used to limit the scope of the claimed subject matter.

In accordance with at least one embodiment of the present invention, a window lock may be configured to be tamper-resistant, and may broadly include a housing, a shaft, a cam, a lever member, a compression spring, and a plate member.

The housing may be formed with a single wall shaped to form an interior surface that defines a cavity, and which wall may terminate in a flat surface configured to be mounted onto the meeting rail. In another embodiment the wall may alternately be formed of a plurality of wall portions. The housing may have an orifice interconnected with the cavity; and an elongated recess formed in the interior surface of the wall;

The shaft may be rotatably mounted in the housing orifice, for a portion of the shaft to protrude into the cavity, and a portion of the shaft to protrude out and away from the exterior surface of the housing. The shaft may be formed with a first curved recess, and a second curved recess, both of which may contribute to the tamper-proof nature of the sash lock.

The cam may be pivotally mounted to the shaft within the housing cavity. The cam may be formed with a first shaped opening and a second shaped opening, at first and second respective positions. The cam may also be formed with an arcuate recess that may have a first end and a second end. The cam may thus be configured to rotate in a first direction out of the housing opening into an extended position where it may engage a keeper secured on an upper sash window or on the master window frame, to lock the sash windows. The cam may also rotate in a second direction from the locked cam position to retract into the housing cavity to unlock the sash windows.

The lock may also include a lever member, a portion of which may be fixedly secured to the shaft. The lever member may be formed to include a protrusion which may be sized and shaped to alternately engage each of the first and second ends of the arcuate recess to respectively drive the cam in each of the first and second directions, respectively.

The plate member may be formed to include a first portion configured to be slidably received within the elongated recess of the housing. One end of the first portion of the plate member may be formed into a curved surface that may be shaped to correspond to the first curved recess, and also the second curved recess in the shaft, which recesses may be formed to have the same shape/envelope. In one embodiment the curved surface may be formed to be a portion of a cylindrical surface. In another embodiment the curved surface may be formed to be a portion of a spherical surface. In a different embodiment, other curved surface shapes may also be suitably utilized. The plate member may be formed with a second portion that may be configured to extend from the first portion of the plate member, and which may be sized and shaped to slidably receive the compression spring thereon. In one embodiment, the second portion may have a cylinder. The plate member may also be formed with a protrusion that may be sized and shaped to be slidably received within the first shaped opening of the cam, and also the second shaped opening of the cam, which may be formed, to be the same as the first shaped opening.

With the above-described arrangement, the compression spring may bias the plate member for the second portion of the plate member to be respectively received within each of the first shaped opening and the second shaped opening of the cam, when rotated to be aligned therewith, and for the curved surface of the plate member to be correspondingly received within the first curved recess and the second curved recess, respectively, when correspondingly rotated to be aligned therewith.

Upon rotating the shaft in the second direction, with the cam in the extended lock position, a transition surface adjacent to the first curved recess of the shaft may engage the curved surface of the plate member to oppose the spring bias to cause the protrusion of the plate member to be withdrawn from the first shaped opening of the cam, to permit the cam to be driven in the second direction by contact from the protrusion of the lever member with one end of its arcuate recess.

Upon rotating the shall in the first direction, with the cam in the retracted position, the transition surface adjacent to the second curved recess of the shaft may engage the curved surface of the plate member to again oppose the spring bias to cause the protrusion of the plate member to be withdrawn from the second shaped opening of the cam, but to now permit the cam to be driven in the first direction by contact from the protrusion of the lever member with a second end of its arcuate recess.

These components and particular features of the above-described lock may be such that the arcuate recess in the cam is configured for the joined shaft and lever member to rotate 50 degrees from the locked cam position in the second direction before the cam is driven by the lever member to co-rotate in the second direction, and may also be configured for the shaft to rotate a total of 140 degrees for the cam to be driven from the locked cam position to the unlocked cam position. The tamper-resistant lock may also be configured for the shaft to rotate 90 degrees in the first direction from the unlocked earn position, before the cam is driven by the lever member to co-rotate in the first direction.

BRIEF DESCRIPTION OF THE DRAWINGS

The description of the various example embodiments is explained in conjunction with appended drawings, in which.

DETAILED DESCRIPTION OF THE INVENTION

As used throughout this specification, the word "may" is used in a permissive, sense (i.e., meaning having the potential to), rather than the mandatory sense (i.e., meaning must). Similarly, the words "include", "including", and "includes" mean including but not limited to.

The phrases "at least one", "one or more", and "and/or" are open-ended expressions that are both conjunctive and disjunctive in operation. For example, each of the expressions "at least one of A, B and C" "one or more of A, B, and C", and "A, B, and/or C" mean all of the following possible combinations: A alone; or B alone; or C alone; or A and B together; or A and C together: or B and C together; or A, B and C together.

Also, all references (e.g., patents, published patent applications, and non-patent literature) that are cited within this document are incorporated, herein in their entirety by reference.

Furthermore, the described features, advantages, and characteristics of any particular embodiment disclosed herein, may be combined in any suitable manner with any of the other embodiments disclosed herein.

It is further noted that any use herein of relative terms such as "top," "bottom," "upper," "lower," "vertical," and "horizontal" are merely intended to be descriptive for the reader, based on the depiction of those features within the figures for one particular position of the lock on one particular window, and such terms are not intended to limit the orientation with which the device of the present invention may be utilized, not the type of fenestration products upon which it may be used.

The tamper-resistant lock 101 may be used to secure many different fenestration products with members that may move with respect to another. For example, the lock 101 may be used to secure one or more sashes of a sash window assembly, the sash window assembly having a lower sash window formed with a meeting rail, a bottom rail, and a pair of stiles, being slidably disposed in a master window frame, and an upper sash window that may have a keeper.

Figure 1:
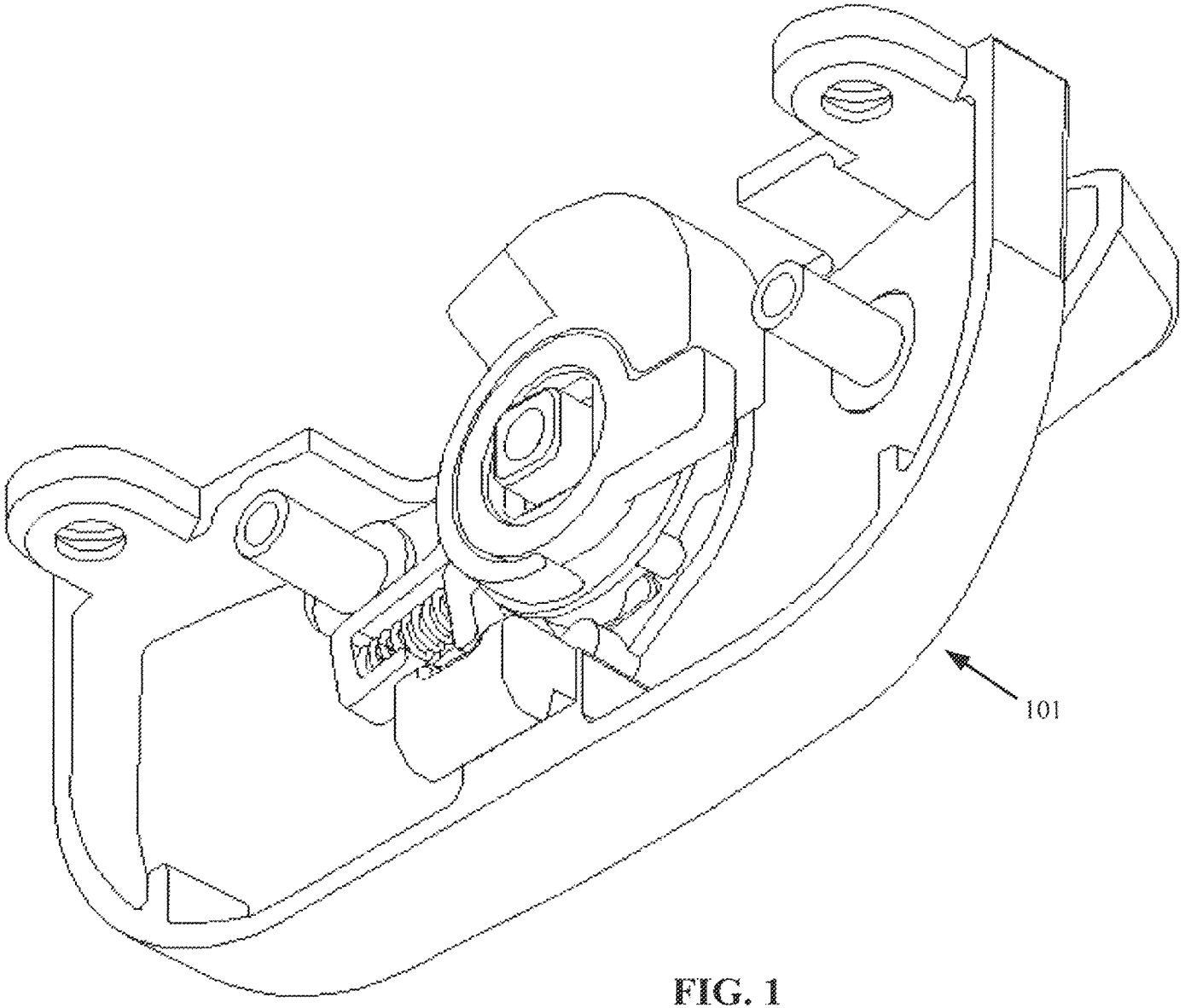
FIG. 1 is a bottom perspective view of the tamper-resistant sash lock as disclosed herein.

In accordance with at least one embodiment of the present invention, a tamper-resistant lock 101 may broadly include a housing 110, a shaft/handle member 140, a plate member 150, a cam 160, a lever member 180, and a spring 190, which may be a compression spring. One embodiment of these parts that may be used for the lock 101 is shown in an exploded view in FIG. 1A, and are also shown assembled in the perspective view of FIG. 1.

Perspective views of the housing 110 are shown in FIGS. 2-3 and FIGS. 10-11, while corresponding orthogonal views are shown in FIGS. 4-9. The housing 110 is not limited to the shape illustrated within those figures and could take on many different suitable shapes, including a rectangular shape, an irregular shape, etc. However, the housing 110 may desirably be formed of at least one wall that may be shaped to form an exterior surface 110E, and an interior surface 110N that defines a cavity, and which, wall may terminate in a generally flat bottom 121 that may be configured to rest upon the top of the meeting rail. The housing wall may span from a first end 111 to second end 112. The bottom 121 may be open as shown, or the wall may extend over only a portion of the bottom of the housing. The housing wall may also be shaped to form a generally flat surface 113, which may have an opening 114 that interconnects with the cavity of the housing. The wall of housing 110 may extend beyond the bottom 121 to form a first protrusion 115 and a second protrusion 116, each of which may have a respective mounting hole 115H/116H formed therein for receiving a fastener for securing the sash lock 101 to the meeting rail of the sliding sash window. A leg 117 may extend from an opposite side of the housing 110, which may be received within an opening in the meeting rail, to be used in combination with the mounting holes 105H/106H for securing the sash lock 101 to the meeting rail. An orifice may also be formed in a top portion of the housing 110 which may also be interconnected with the cavity.

Extending away from the interior surface 110N of the housing 110 may be at least one cylindrical protrusion that may extend to terminate on a planar extension of the flat surface 111, and may be used to support a central portion of the wall. In one embodiment, two such protrusions 123/124 may be utilized, each of which may be hollow.

The housing 111 may have a cylindrical boss 18 extending upwardly from the outer surface 110E, and may also have a boss (or thickened area) 119 extending downwardly from the interior surface 110N, into the housing cavity. The housing 110 may have, a hole 120 through the boss 118 and boss 119, which may be used for pivotal mounting of the shaft/handle member 140 to the housing. A shaped recess 122 may be formed in the interior of the housing wall in the area 119 of the wall, a portion of which may be elongated.

Figure 18:
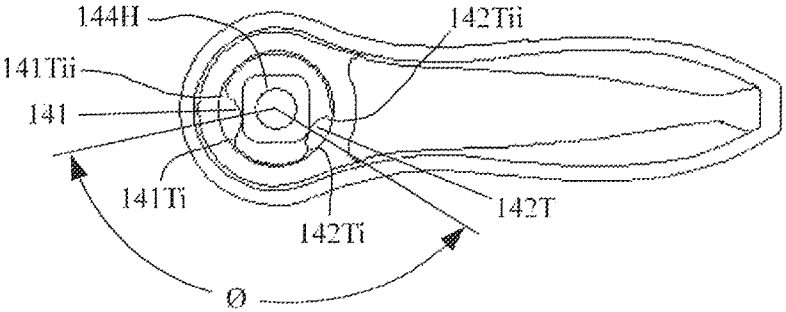
FIG. 18 is a bottom view of the shaft and handle used for the sash lock of FIG. 1.
Figure 20:
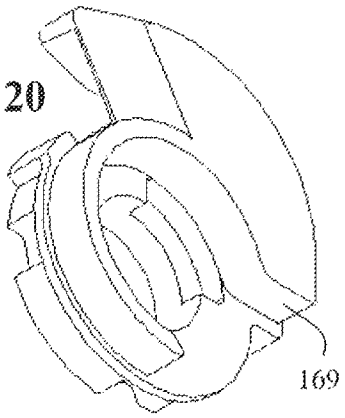
FIG. 20 is a first perspective view of the cam used for the sash lock of FIG. 1.
Figure 27:
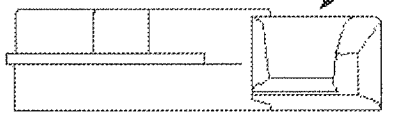
FIG. 27 is a second end view of the cam used for the sash lock of FIG. 1.
Figure 24:
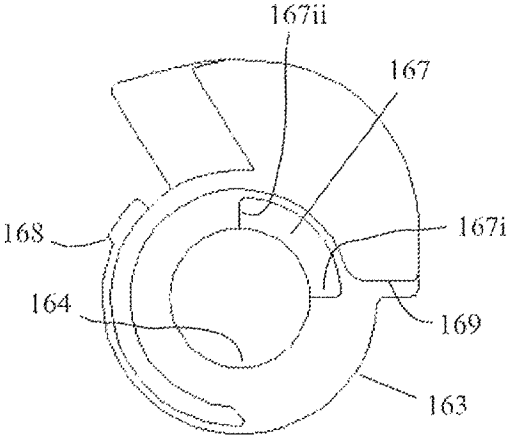
FIG. 24 is a top view of the cam used for the sash lock of FIG. 1.
Figure 23:
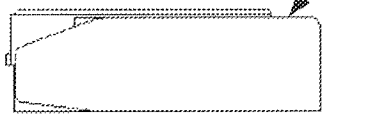
FIG. 23 is a side view of the cam used for the sash lock of FIG. 1.
Figure 25:
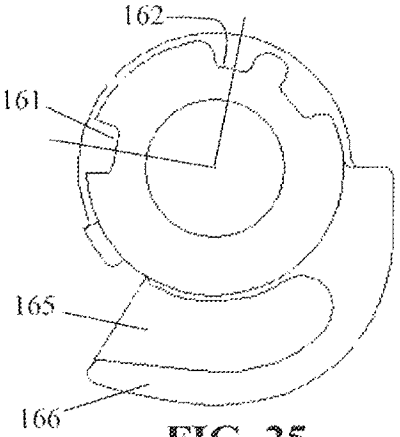
FIG. 25 is a bottom view of the cam used for the sash lock of FIG. 1.
Figure 21:
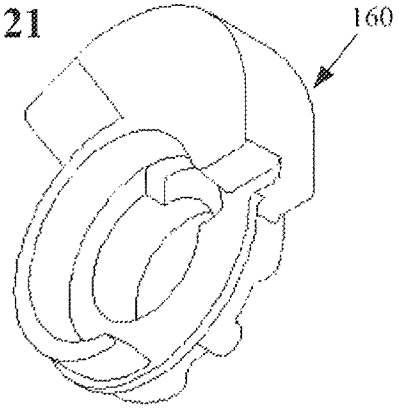
FIG. 21 is a second perspective view of the cam used for the sash lock of FIG. 1.
Figure 26:
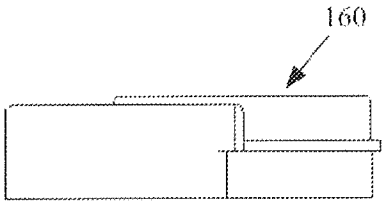
FIG. 26 is a first end view of the cam used for the sash lock of FIG. 1.
Figure 22:
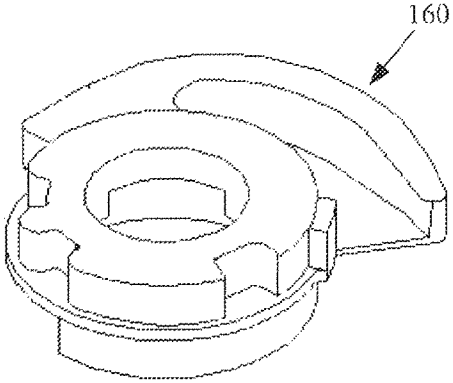
FIG. 22 is a third perspective view of the cam used for the sash lock of FIG. 1.
Figure 28:
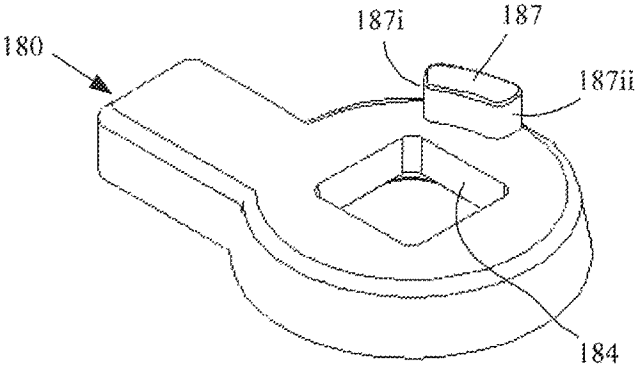
FIG. 28 is a first perspective view of the lever member used for the sash lock of FIG. 1.
Figure 35:
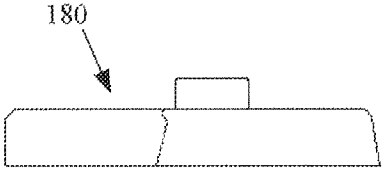
FIG. 35 is a rear view of the lever member used for the sash lock of FIG. 1.
Figure 34:
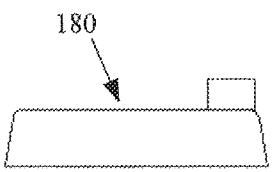
FIG. 34 is a second end view of the lever member used for the sash lock of FIG. 1.
Figure 31:
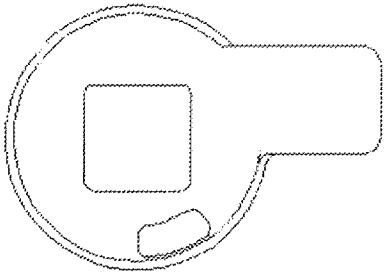
FIG. 31 is a top view of the lever member used for the sash lock of FIG. 1.
Figure 30:
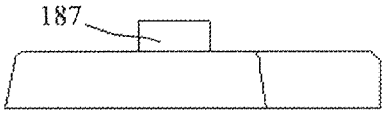
FIG. 30 is a front view of the lever member used for the sash lock of FIG. 1.
Figure 32:
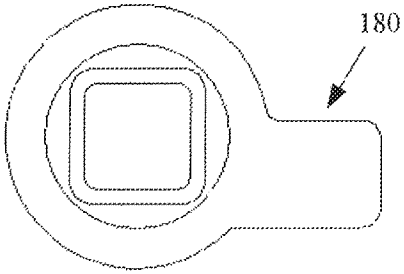
FIG. 32 is a bottom view of the fever member used for the sash lock of FIG. 1.
Figure 29:
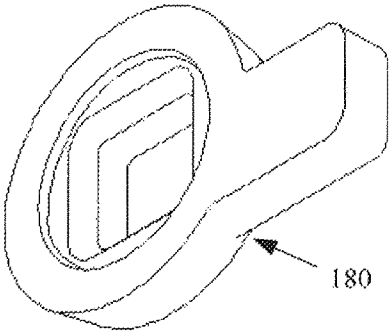
FIG. 29 is a second perspective view of the lever member used for the sash lock of FIG. 1.
Figure 33:
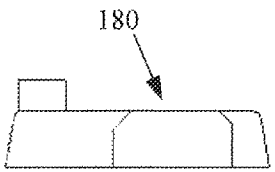
FIG. 33 is a first end view of the lever member used for the sash lock of FIG. 1.
Figure 36:
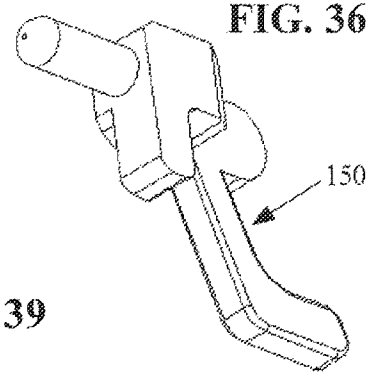
FIG. 36 is a first perspective view of the plate member used for the sash lock of FIG. 1.
Figure 37:
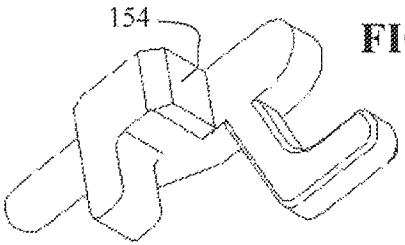
FIG. 37 is a second perspective view of the plate member used for the sash lock of FIG. 1.
Figure 38:
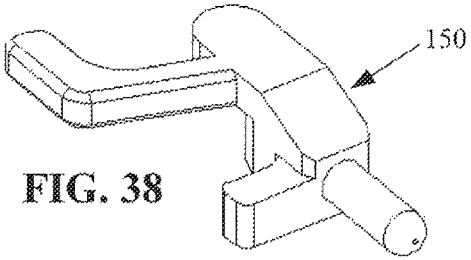
FIG. 38 is a third perspective view of the plate member used for the sash lock of FIG. 1.
Figure 39:
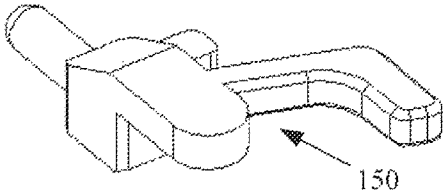
FIG. 39 is a fourth perspective view of the plate member used for the sash lock of FIG. 1.
Figure 41:
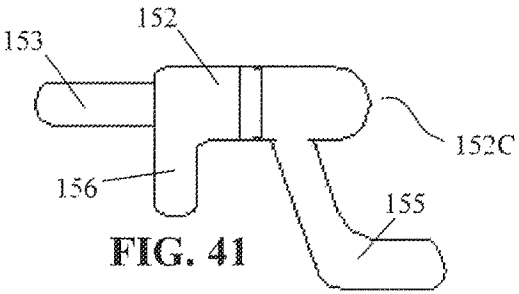
FIG. 41 is a top view of the plate member used for the sash lock of FIG. 1.
Figure 40:
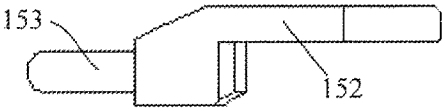
FIG. 40 is a front view of the plate member used for the sash lock of FIG. 1.
Figure 43:
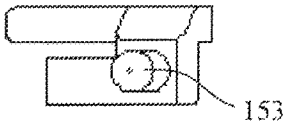
FIG. 43 is a first end view of the plate member used for the sash lock of FIG. 1.
Figure 42:
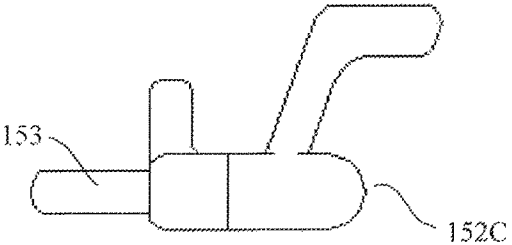
FIG. 42 is a bottom view of the plate member used for the sash lock of FIG. 1.
Figure 45:
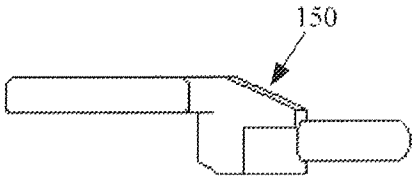
FIG. 45 is a rear view of the plate member used for the sash lock of FIG. 1.
Figure 44:
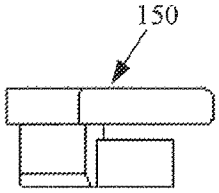
FIG. 44 is a second end view of the plate member used for the sash lock of FIG. 1.
Figure 46:
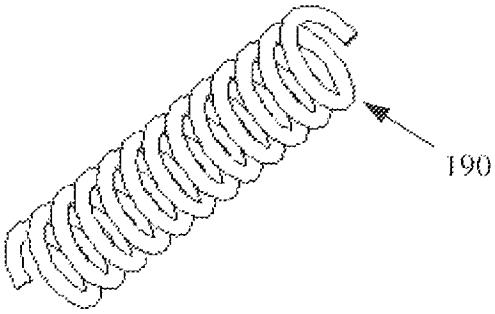
FIG. 46 is a perspective view of the compression spring used for the sash lock of FIG. 1.
Figure 56:
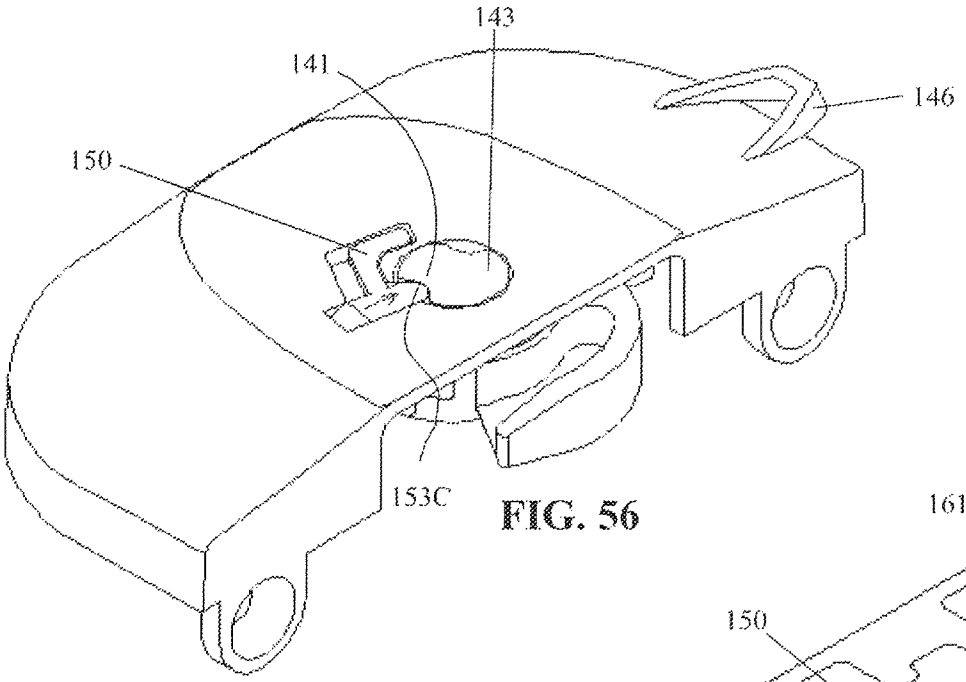
FIG. 56 is a top perspective view of the lock assembly, shown with the top portion cut away to expose the curved surface of the plate member engaged within the first curved recess of the shaft.

As seen in FIGS. 13-19, a shaft/handle member 140 may have a cylindrical shaft 143, one end of which may have a rectangular-shaped protrusion 144 with a hole 144H formed therein, which may receive a rivet or other fastener, for mounting of the lever member 180 thereto. The other end of the shaft 143 may have a knob or other enlarged circular cross-sectional shape to permit that end of the shaft to be easily grasped by the user. In one embodiment, the other end of the shaft 143 may have a graspable handle portion 146 that may extend generally orthogonally with respect to the axis of shaft 143. The shaft 143 may be configured to be pivotally received within the hole 120 in the boss 118 of the housing 110. The shaft 143 may have a first recess 141 that may be formed to extend substantially parallel to the axis of the cylindrical shaft. The recess 141 may be formed of a portion of a cylindrical surface, or may be formed by another curved surface. The curved recess 141 may transition to the cylindrical surface of the shaft 143 using a first curved transition surface 141Ti and a second transition surface 141Tii (FIG. 18). A second recess 142 may be similarly formed, and may similarly transition to the cylindrical surface of the shaft 143 using a first curved transition surface 142Ti and a second transition surface 142Tii. The first recess 141 and the second recess 142 may be clocked on the shaft 143, as shown in FIG. 18, to be particularly oriented for latching of the cam 160 to make the lock 101 tamper-proof, which clocking angle Θ is discussed further hereinafter. In one embodiment, the first recess 141 and the second recess 142 may be clocked 140 degrees apart from each other (i.e., Θ=140°), to permit the handle to be rotated that same amount in moving the cam from the locked (extended) position to an unlocked (retracted) position. Note that in another embodiment, a different angular clocking may be used (e.g., 180 degrees). The first recess 141 may also be clocked on the shaft 143 so that the handle 160 may be oriented as shown in FIG. 56, when the cam 160 is in the locked (extended) cam position.

Figure 53:
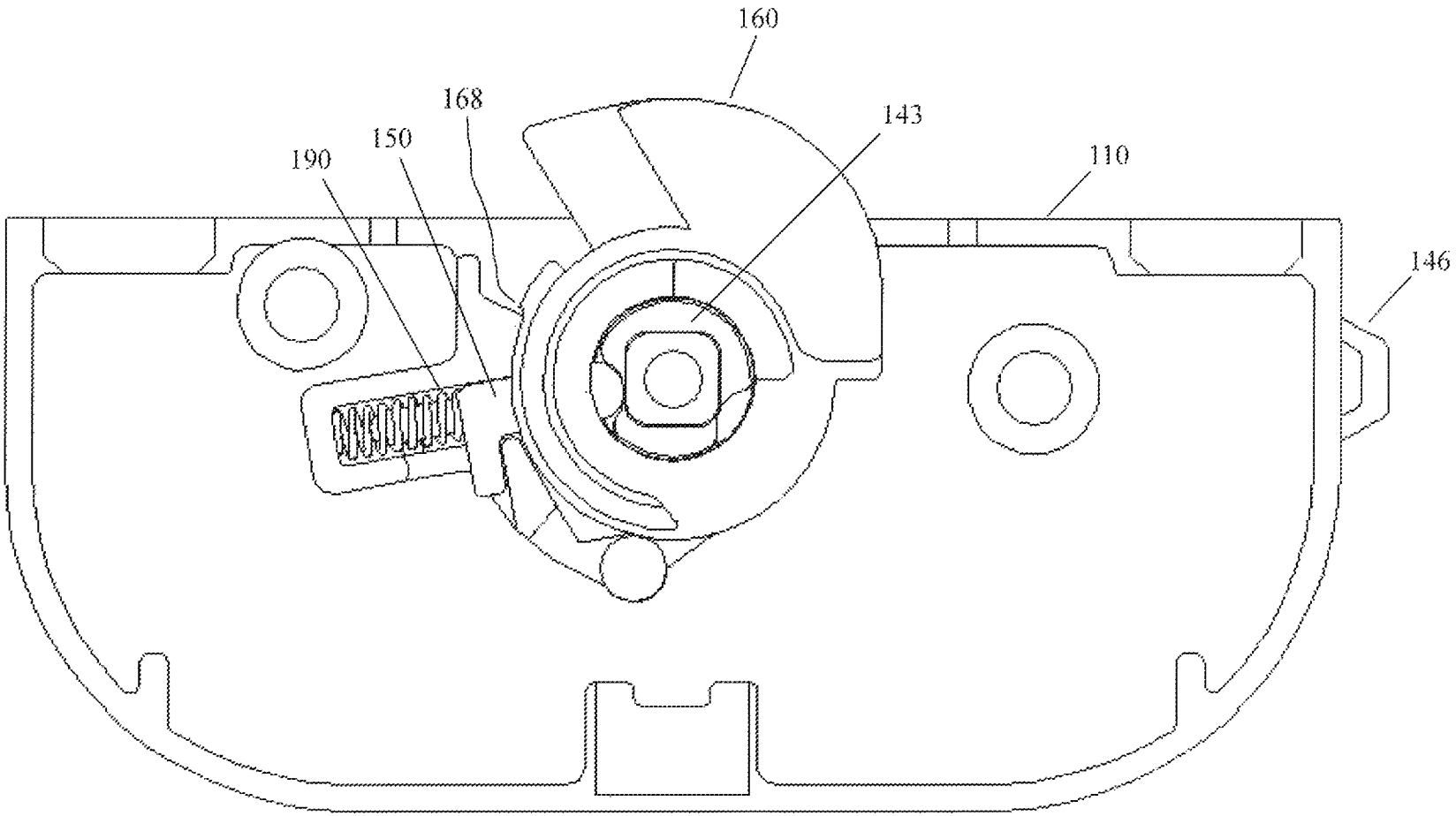
FIG. 53 is the bottom view of FIG. 51, but which also shows the cam received onto the shaft within the housing cavity.
Figure 54:
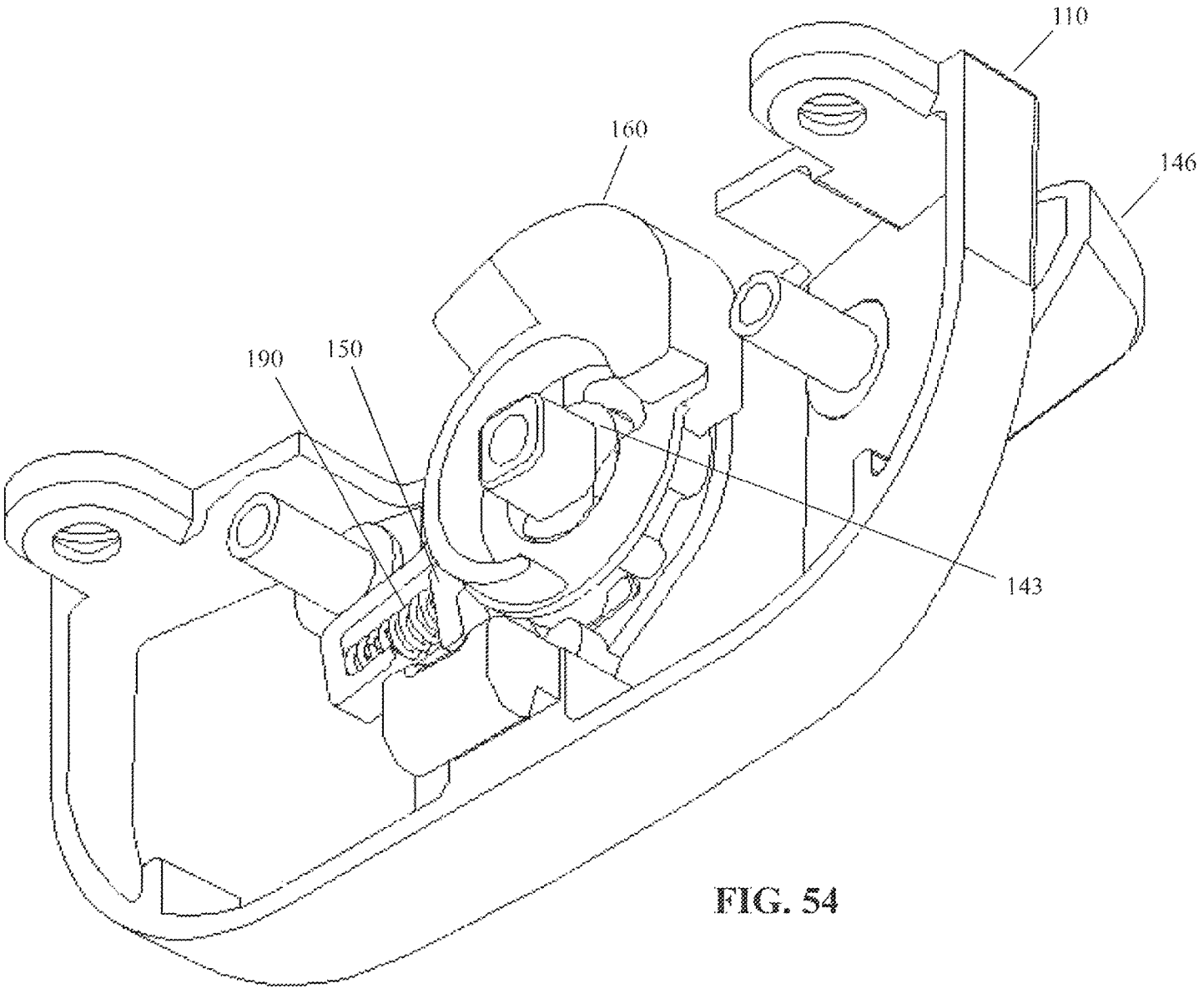
FIG. 54 is a perspective view of the housing with the assembled compression spring and plate member received therein, and the shaft received within the orifice of the housing, with the cam pivotally mounted thereto, as shown in FIG. 53.
Figure 69:
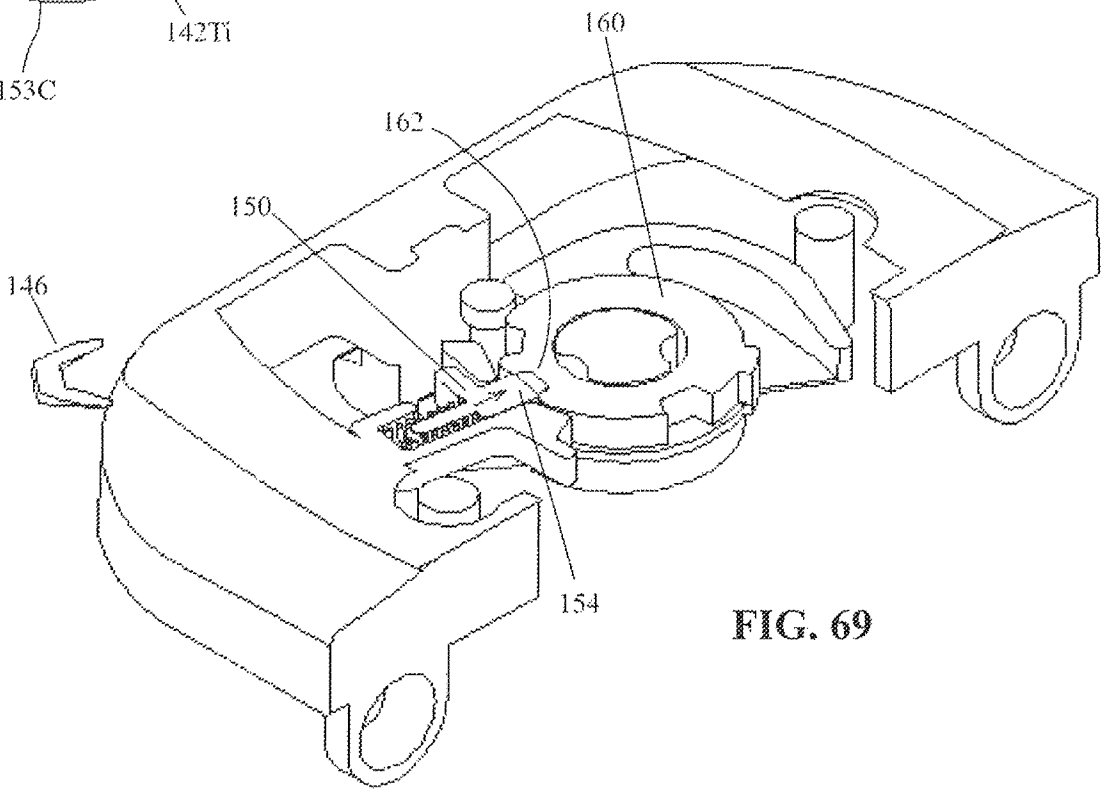
FIG. 69 is the cutaway top perspective view of FIG. 63, but is shown with the handle having been rotated roughly 140 degrees for the protrusion of the plate member to become engaged with the second shaped opening of the shaft, with the earn positioned in the unlocked (retracted) position.
Figure 70:
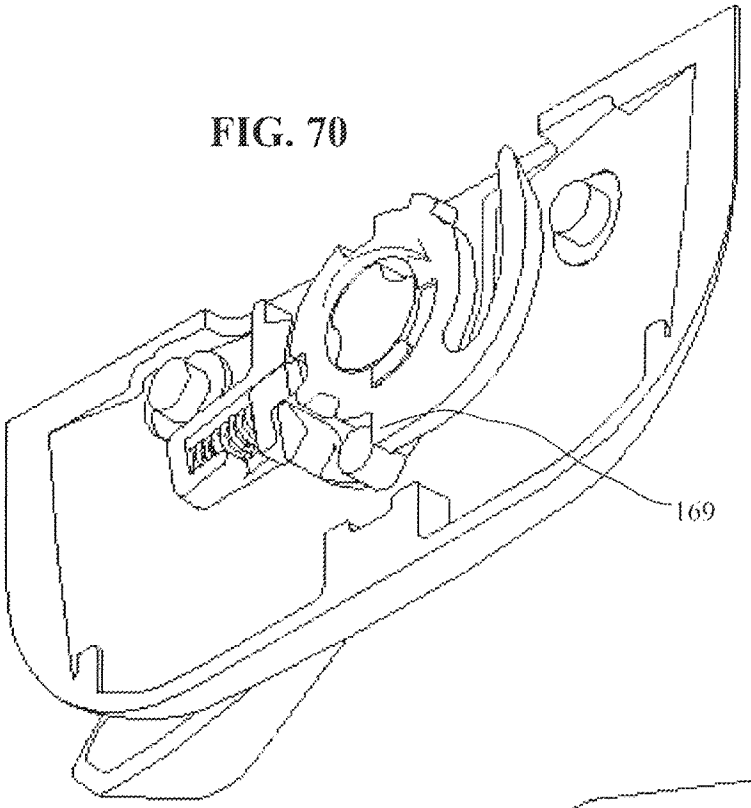
FIG. 70 is the cutaway bottom perspective view of FIG. 64, but is shown with the handle having been rotated roughly 140 degrees for the protrusion of the plate member to become engaged with the second shaped opening of the shaft with the cam positioned in the unlocked (retracted) position.
Figure 71:
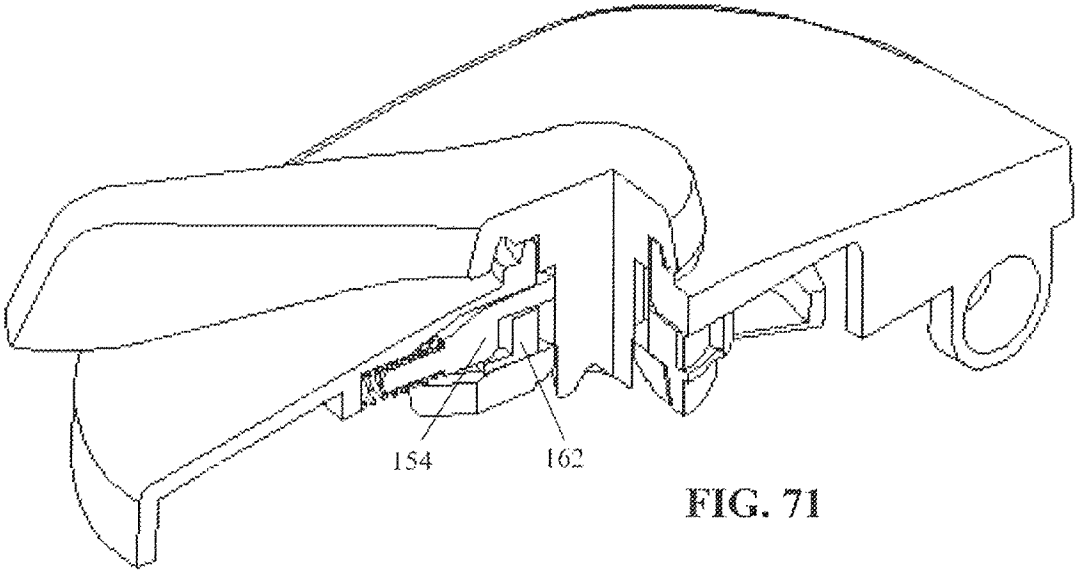
FIG. 71 is the cutaway bottom perspective view of FIG. 59, but is shown with the handle having been rotated roughly 140 degrees for the curved surface of the plate member to become engaged with the second curved recess of the shaft, with the cam then positioned in the unlocked (retracted) position.

The locking cam 160, illustrated in FIGS. 20-27, may have a cylindrical hub 163, with a hole 164 formed therein that is sized to permit the cam to thereby be pivotally mounted to the shaft/handle member 140. Extending laterally away from the hub 165 may be a wall 165, and extending laterally away from the wall 165 may be a curved cam wall 166, which may be used to engage a key of the corresponding keeper, and to draw the sliding sash window in closer proximity to the master window frame (or to the other sash window for a double-hung arrangement). The hub 163 of the cam 160 may have a first shaped opening 161 and a second shaped opening 162 formed at first and second respective positions on the hub. The first shaped opening 161 may be formed thereon relative to the wall 166 to be clocked so that it may be properly engaged, as discussed hereinafter, when the cam 160 is in the locked (extended) cam position (e.g., FIG. 57). The second shaped opening 162 may be clocked relative to the first shaped opening 161 so that it may be properly engaged, as discussed hereinafter, when the cam 160 is in the unlocked (retracted) cam position (e.g., FIG. 69). The clocking between the first shaped opening 161 and the second, shaped, opening 162 may depend upon the unconnected movement between the shaft 140 and the cam 160 (i.e., when they do not co-rotate). In one embodiment, the first shaped opening 161 and the second shaped opening 162 may be clocked to be 90 degrees apart, which, for the 140 degree clocking of the first recess 141 and the second recess 142 of the shaft/handle member 140, may result in 50 degrees of unconnected movement between the shaft 140 and the cam 160, as discussed further hereinafter. A recess 167, which may be annular, may be formed in the hub 163, having a first end 167*i*, and a second end 167*ii* The ends 167*s* and 167*ii* of the recess 167 may also be clocked to be 90 degrees apart, as those ends may provide an engagement surface by which the cam 160 may be driven by the lever member 180. A protruding feature (e.g., protrusion 168) may be formed on the hub 163 to engage a corresponding feature on the housing 110 to serve as a stop, to limit, outward pivotal travel, of the cam 160 at the locked (extended) cam position (FIG. 53). Another protruding feature (e.g., protrusion 169) may be formed on the hub 163 to engage a corresponding feature on the housing 110 to serve as another stop, and may limit pivotal travel, of the earn 160 into the housing cavity to be at the unlocked (retracted) cam position (FIG. 70).

The lever member 180, illustrated in FIGS. 28-35, may be configured to be secured to the rectangular shaped protrusion 144 at the end of the shaft 143, in any suitable manner (e.g., using one or a plurality of mechanical fasteners). In one embodiment the lever member may be formed as a flat plate with a rectangular shaped recess 184 that may be sized to be received upon the rectangular shaped protrusion of the 144 at the end of the shaft 143. Instead of the rectangular through-opening shown in FIG. 31, a hole (not shown) may be formed in the lever member 180 for receiving a mechanical fastener (e.g., a rivet, a screw, etc.) therethrough, and into the hole 144H of the shaft/handle member 140, for securing the lever member to the shaft. The Sever member 180 may also be formed with a protrusion 187 that may have a first side 187*i* and a second side 187*ii* that are respectively configured to alternately engage each of the first end 167*i* and the second end 167*ii* of the arcuate recess 167 of the cam 160, to be able to drive the cam in each of a first and a second direction, between the unlocked (retracted) cam position and the locked (extended) cam position.

The plate member 150, illustrated in FIGS. 36-45, may be formed with a first portion 152 that may be configured to be slidably received within the elongated recess 122 of the housing 110. A corresponding cross-sectional shape may be used for each of the first portion 152 and the recess 122, which may be a circular cross-section, or a square cross-section, etc. A free end of the first portion 152 of the plate member may be formed into a curved surface 152C. The curved surface 152C may be shaped to correspond to the shape of the first and second curved recesses 141/142 of the shaft/handle member 140. The plate member 150 may also be formed with a second portion 153 that may be configured to extend from the first portion of the plate member, and may be configured to slidably receive the helical compression spring 190 thereon (FIG. 47), which may be used to bias the curved surface 152C of the plate member 150 into contact with the shaft 140 (see e.g., FIG. 51). The plate member 150 may also be formed with a protrusion 154 that may be shaped to be received within each of the first shaped opening 161 of the cam 160, and the second shaped opening 162 of the cam, both of which may be formed with the same shape. The plate member 150 may also be formed with a shaped protrusion 155 that may be received within a correspondingly shaped recessed portion in the housing, which may serve in guiding the movement of the plate member towards the shaft/handle member 140, in addition to, or as an alternative to, the first portion 152 and the recess 122. The plate member 150 may also be formed with a protrusion 156 that may co-act with a feature on the housing 110 to serve as a stop to limit the biased movement of the plate member towards the shaft/handle member 140.

Figure 1A:
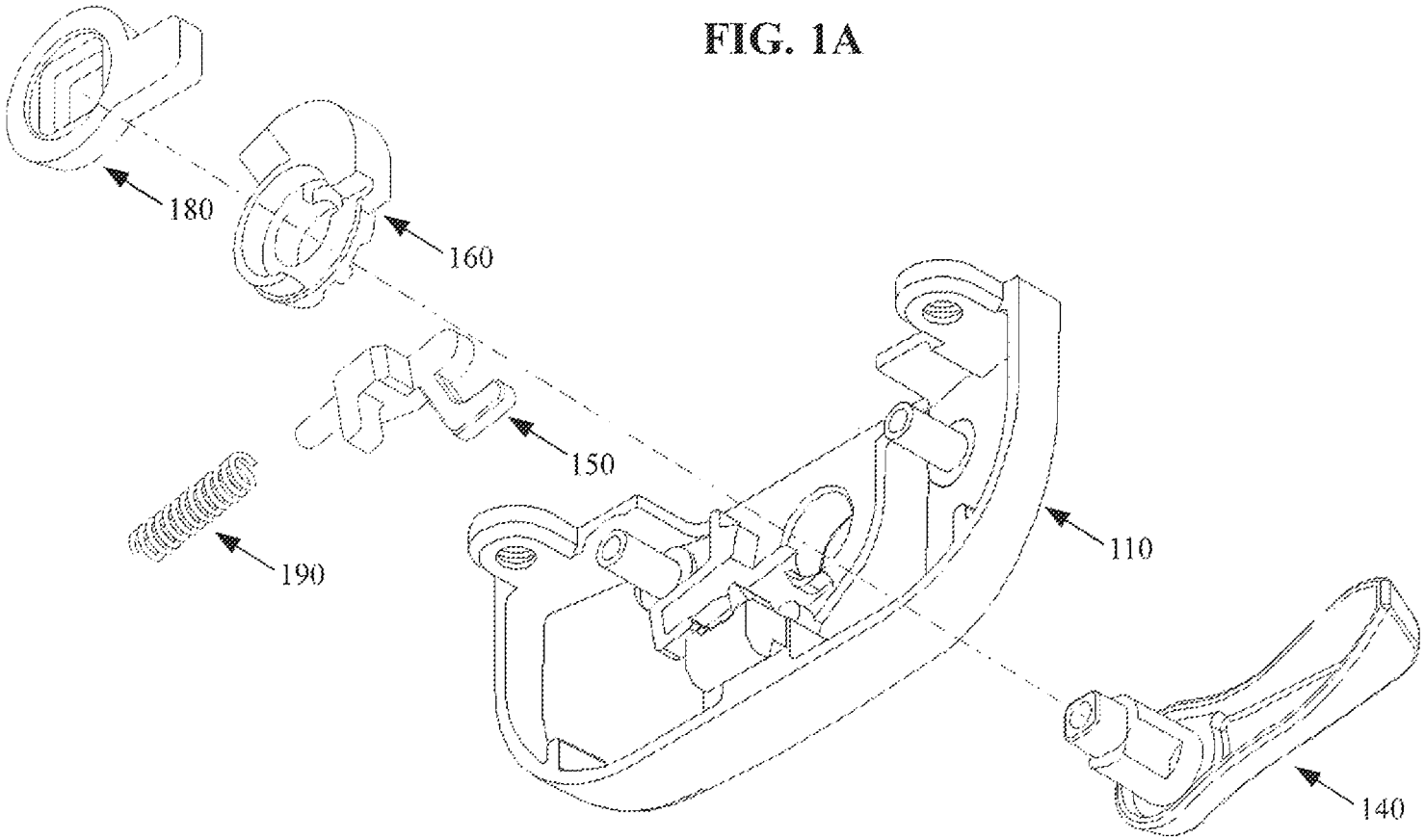
FIG. 1A is an exploded view of the parts that make up the sash lock of FIG. 1.
Figure 3:
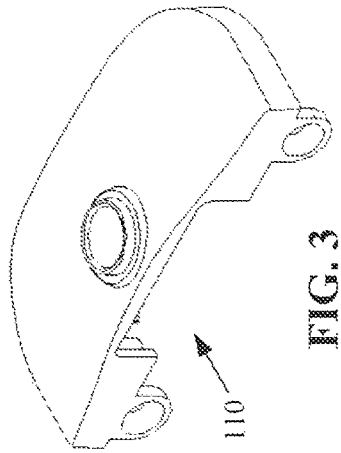
FIG. 3 is a second top perspective view of the housing used for the sash lock of FIG. 1.
Figure 2:
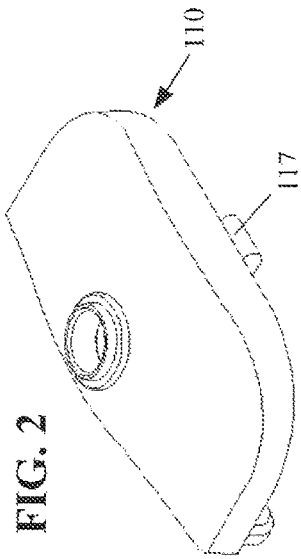
FIG. 2 is a first top perspective view of the housing used for the sash lock of FIG. 1.
Figure 5:
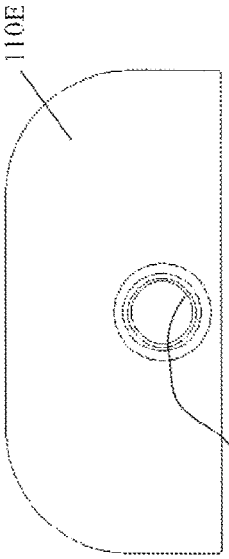
FIG. 5 is a top view of the housing used for the sash lock of FIG. 1.
Figure 4:
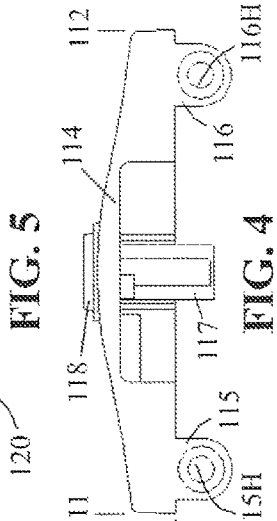
FIG. 4 is a front view of the housing used for the sash lock of FIG. 1.
Figure 7:
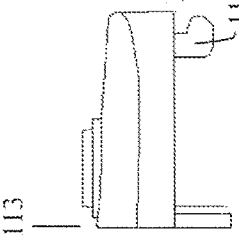
FIG. 7 is a first end view of the housing used for the sash lock of FIG. 1.
Figure 9:
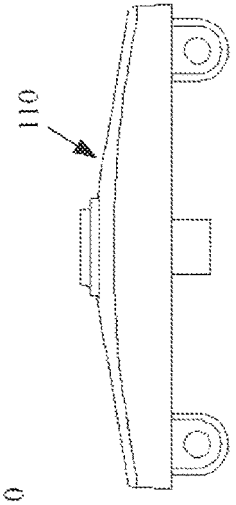
FIG. 9 is a rear view of the housing used for the sash lock of FIG. 1.
Figure 8:
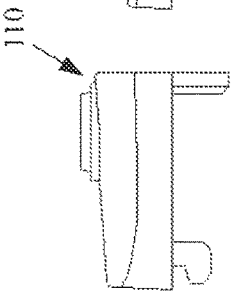
FIG. 8 is a second end view of the housing used for the sash lock of FIG. 1.
Figure 6:
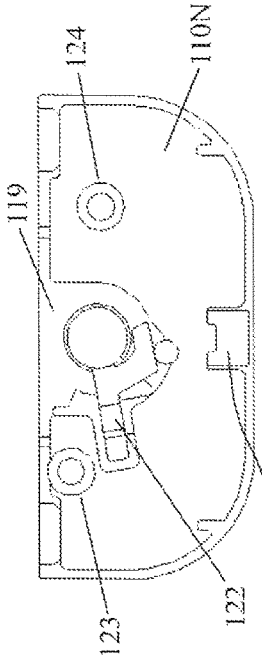
FIG. 6 is a bottom view of the housing used for the sash lock of FIG. 1.
Figure 10:
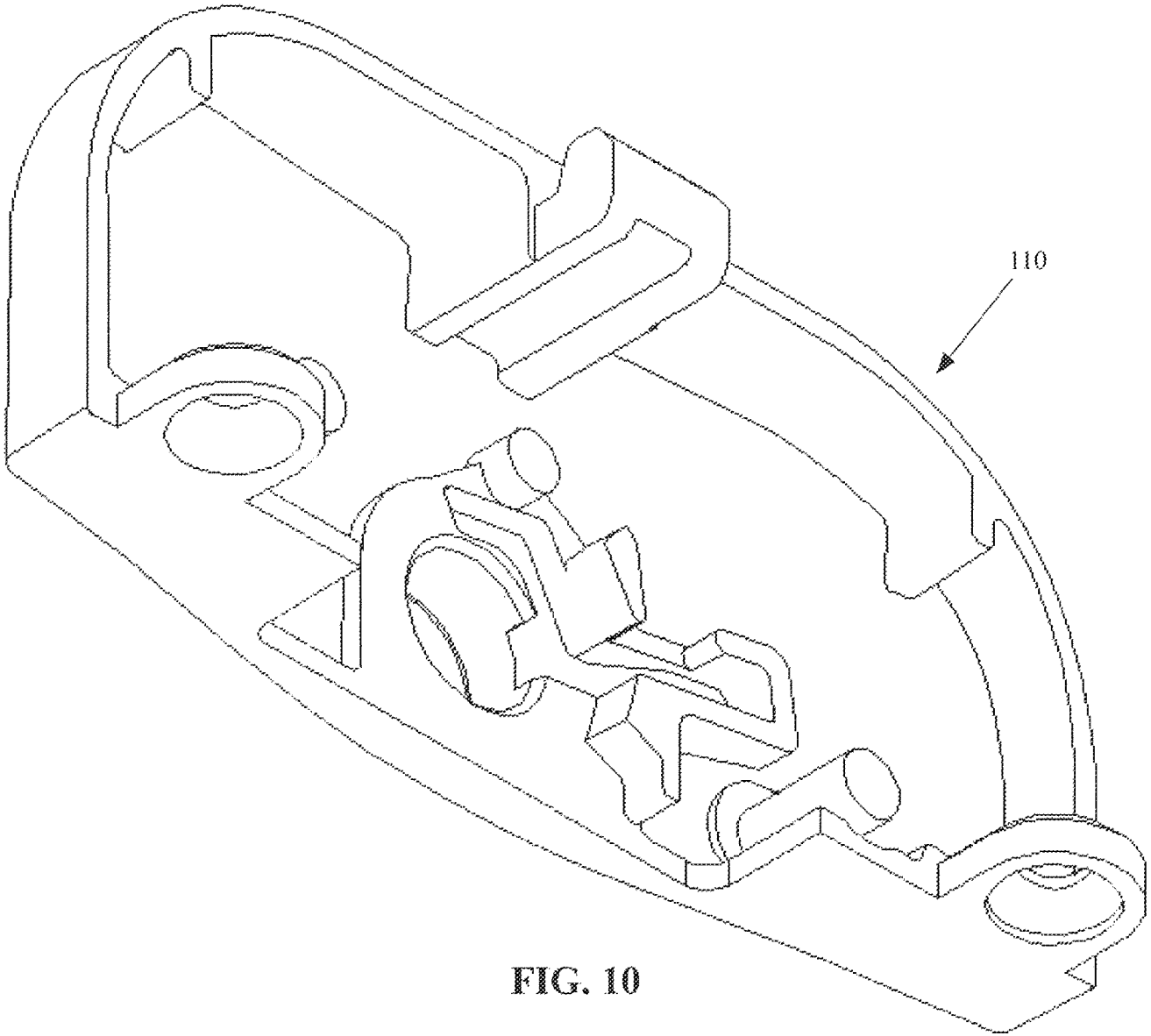
FIG. 10 is a first bottom perspective view of the housing used for the sash lock of FIG. 1.
Figure 11:
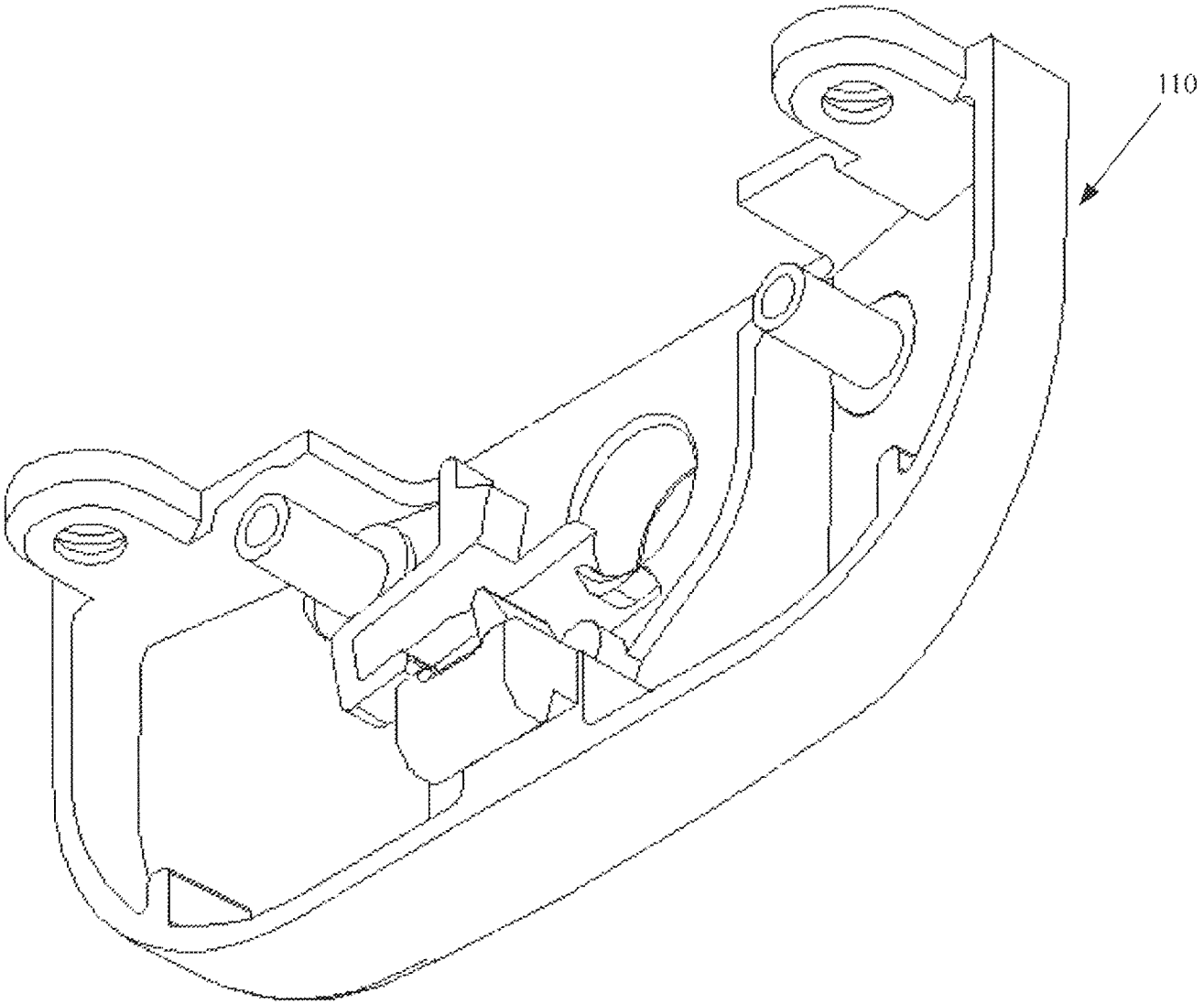
FIG. 11 is a second bottom perspective view of the housing used for the sash lock of FIG. 1.
Figure 12:
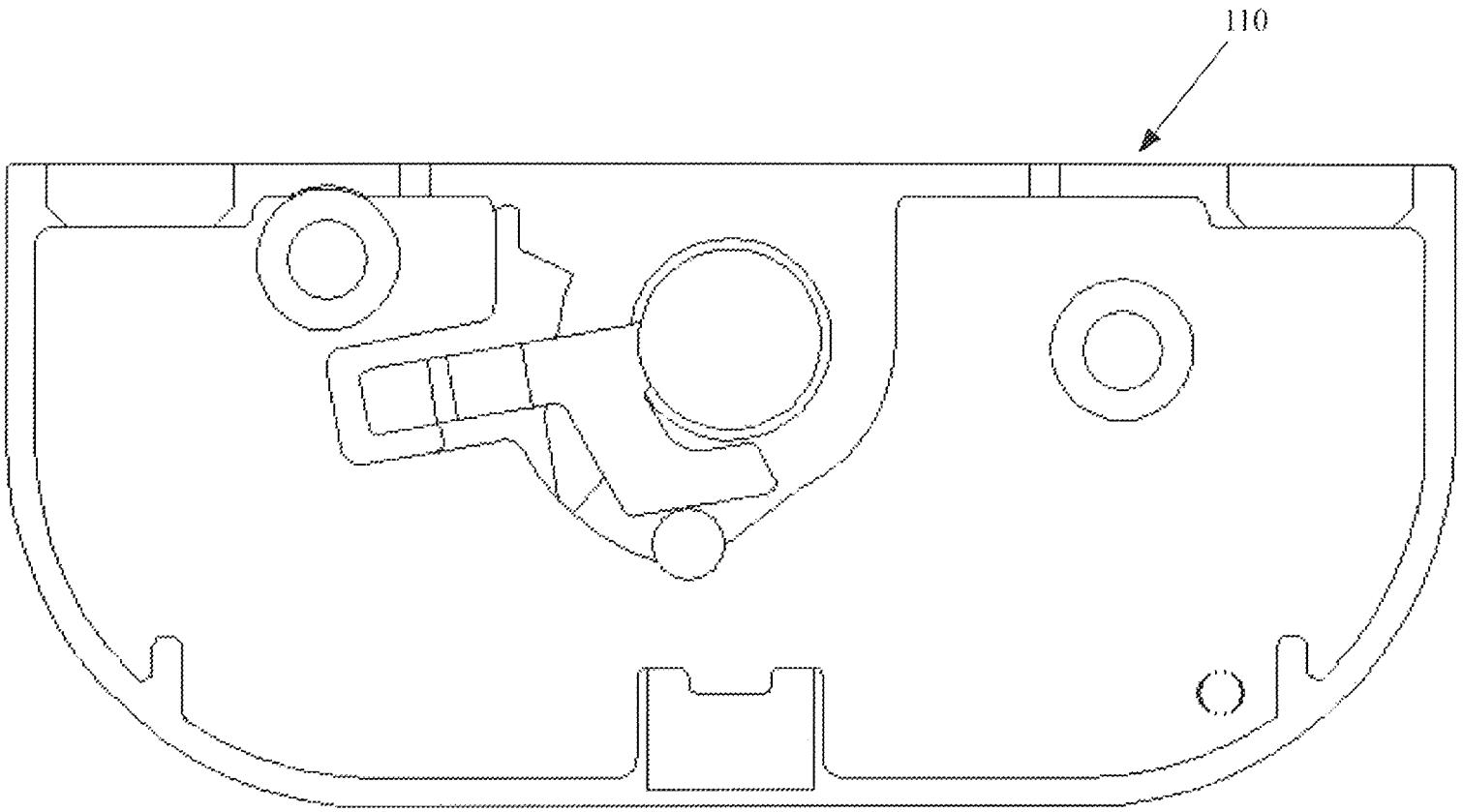
FIG. 12 is the housing bottom view of FIG. 6, but is shown enlarged.
Figure 13:
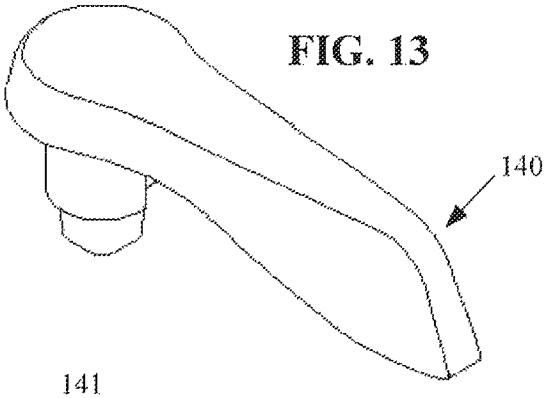
FIG. 13 is a top perspective view of the shaft and handle used for the sash lock of FIG. 1.
Figure 14:
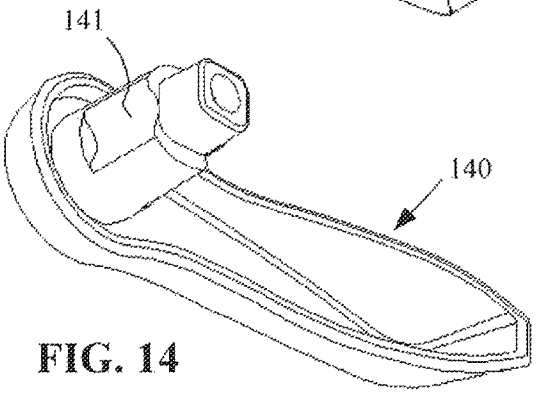
FIG. 14 is a first bottom perspective view of the shaft and handle used for the sash lock of FIG. 1.
Figure 15:
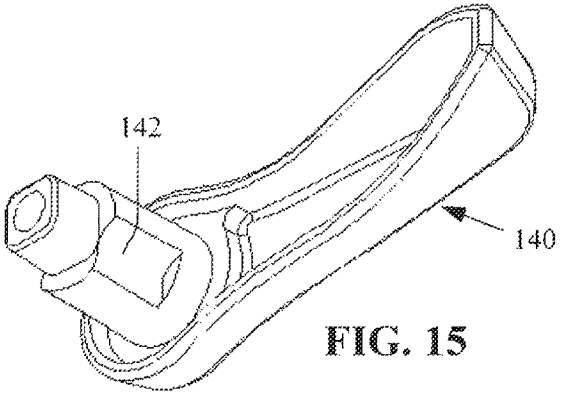
FIG. 15 is a second bottom perspective view of the shaft and handle used for the sash lock of FIG. 1.
Figure 17:
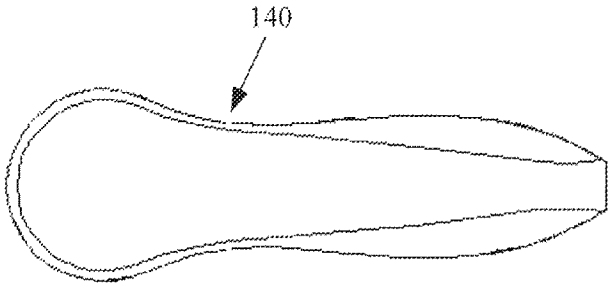
FIG. 17 is a top view of the shaft and handle used for the sash lock of FIG. 1.
Figure 16:
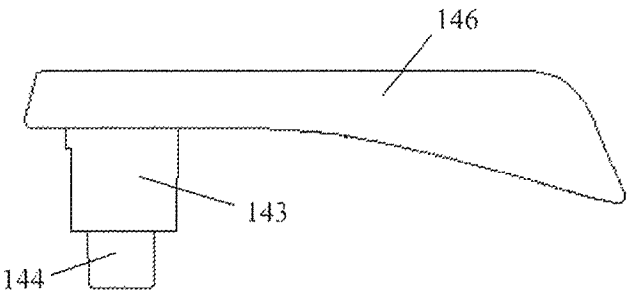
FIG. 16 is a side view of the shaft and handle used for the sash lock of FIG. 1.
Figure 19:
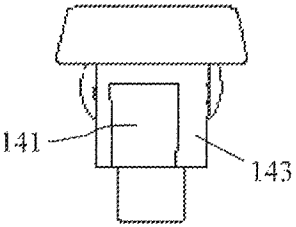
FIG. 19 is an end view of the shaft and handle used for the sash lock of FIG. 1.
Figure 47:
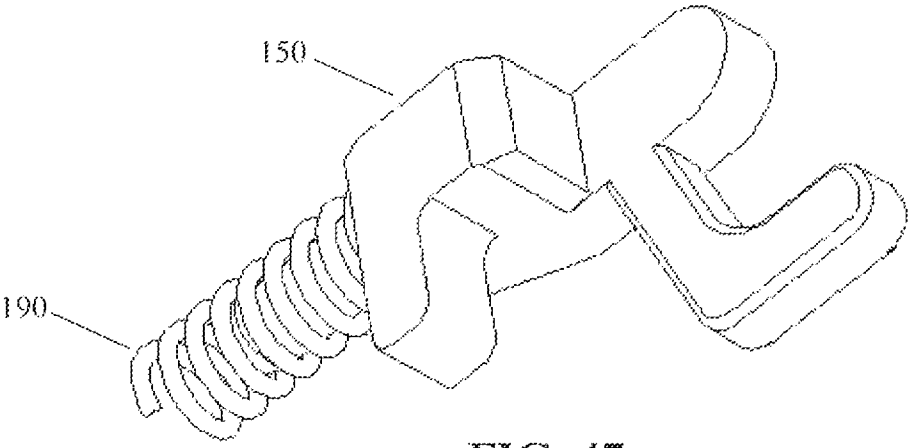
FIG. 47 is a perspective view illustrating the compression spring of FIG. 46 received upon a post of the plate member of FIG. 37.
Figure 48:
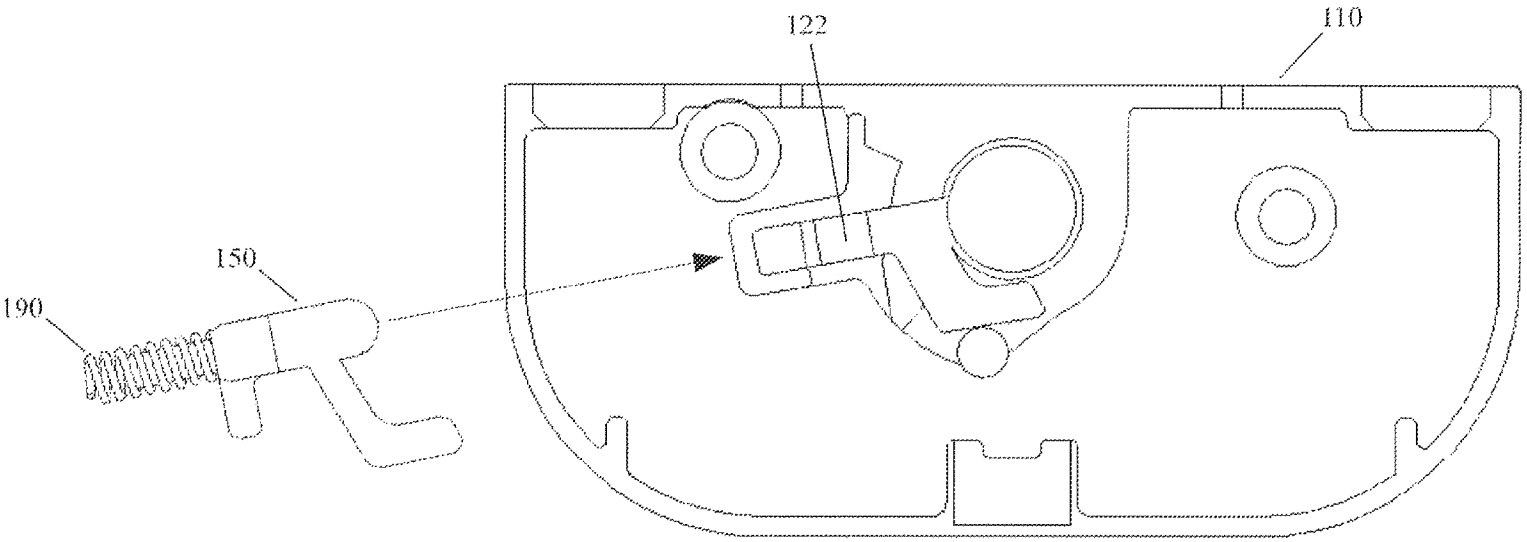
FIG. 48 illustrates the bottom view of the housing shown in FIG. 12, just prior to receiving the assembled compression spring and plate member of FIG. 47 therein.
Figure 49:
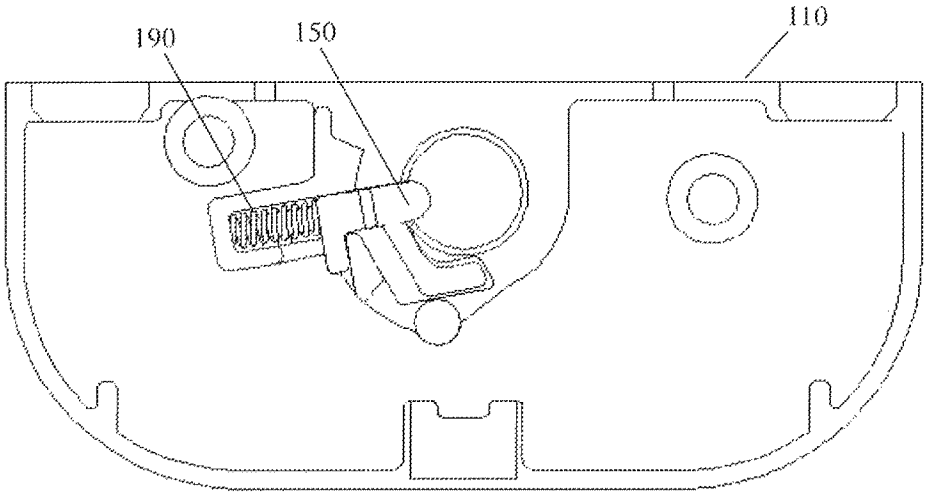
FIG. 49 illustrates the bottom view of the housing shown in FIG. 48, just after receiving the assembled compression spring and plate member therein.
Figure 50:
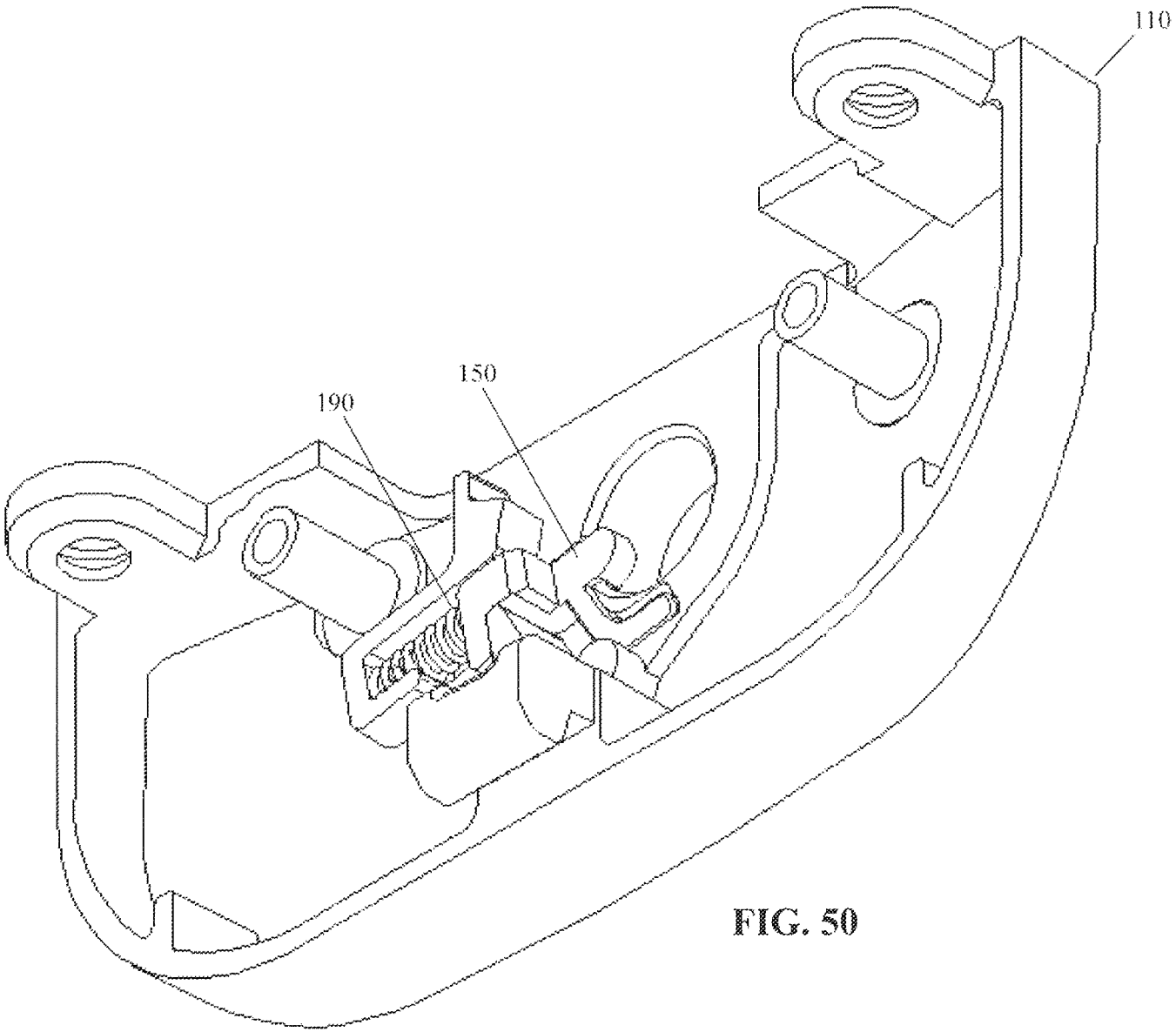
FIG. 50 is a perspective view illustrating the housing with the assembled compression spring and plate member received therein.
Figure 51:
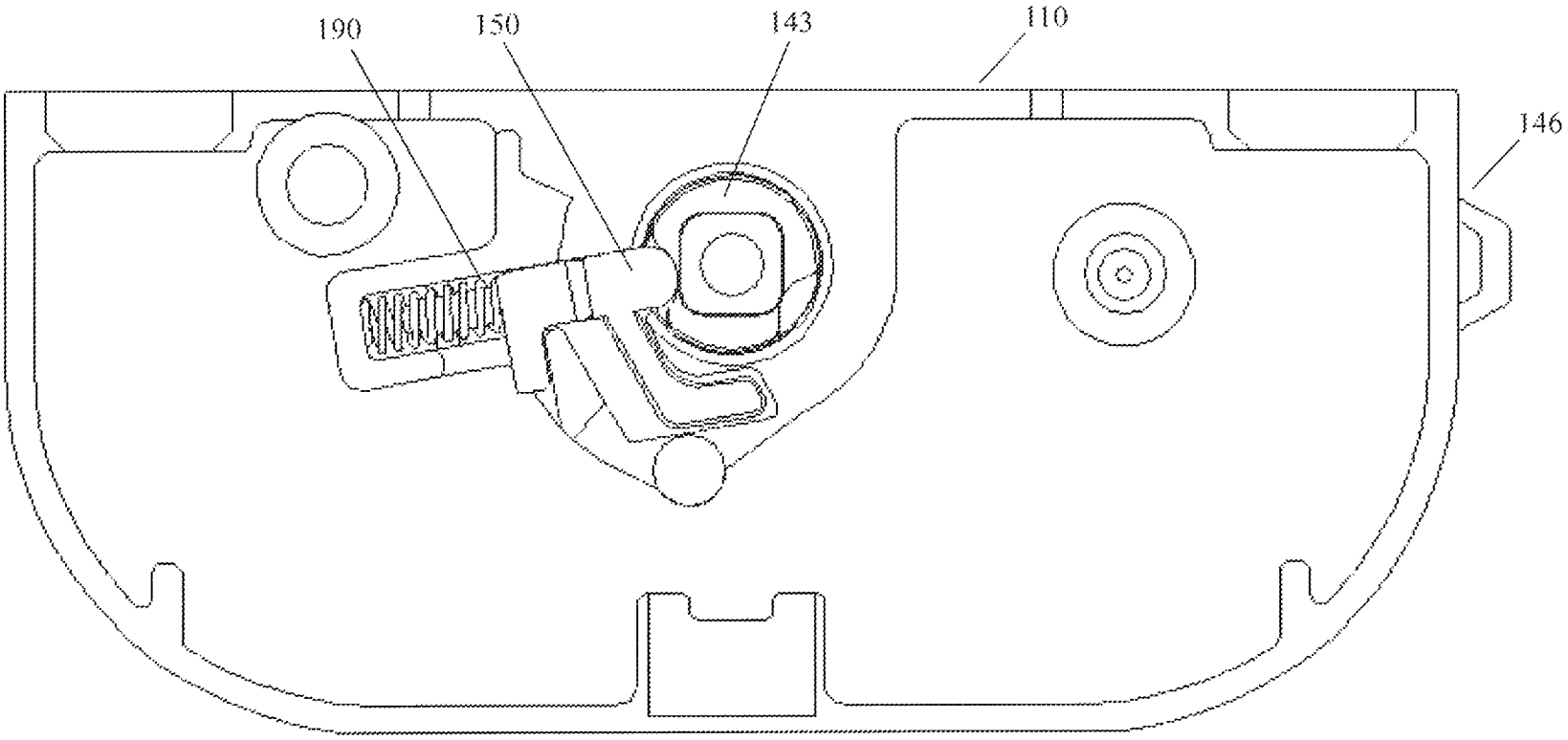
FIG. 51 is the bottom view of FIG. 48, but which also shows the shaft received within an orifice of the housing.
Figure 52:
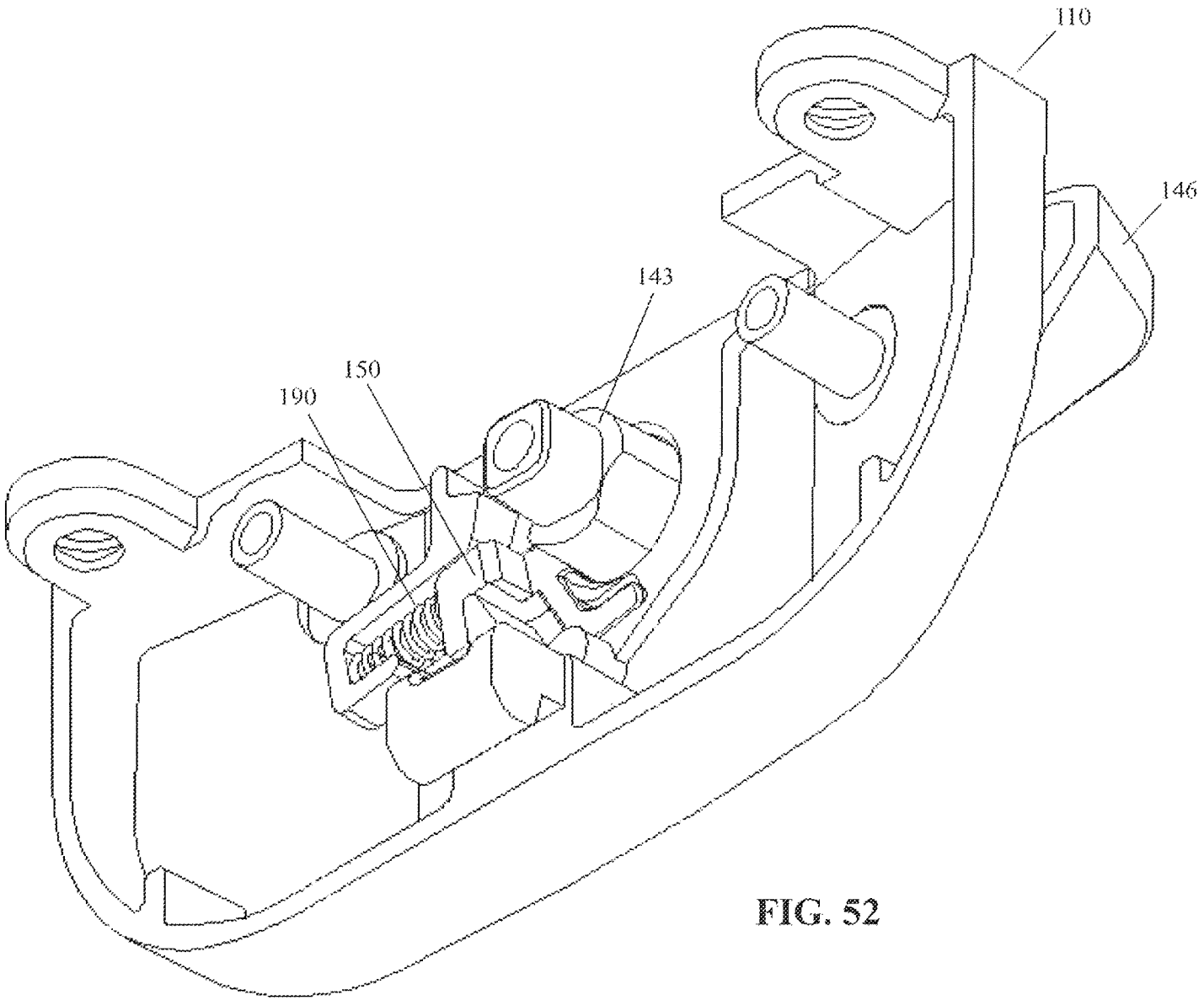
FIG. 52 is a perspective view showing the housing with the assembled compression spring and plate member received therein, and the shaft received within the orifice of the housing, as shown in FIG. 51.
Figure 55:
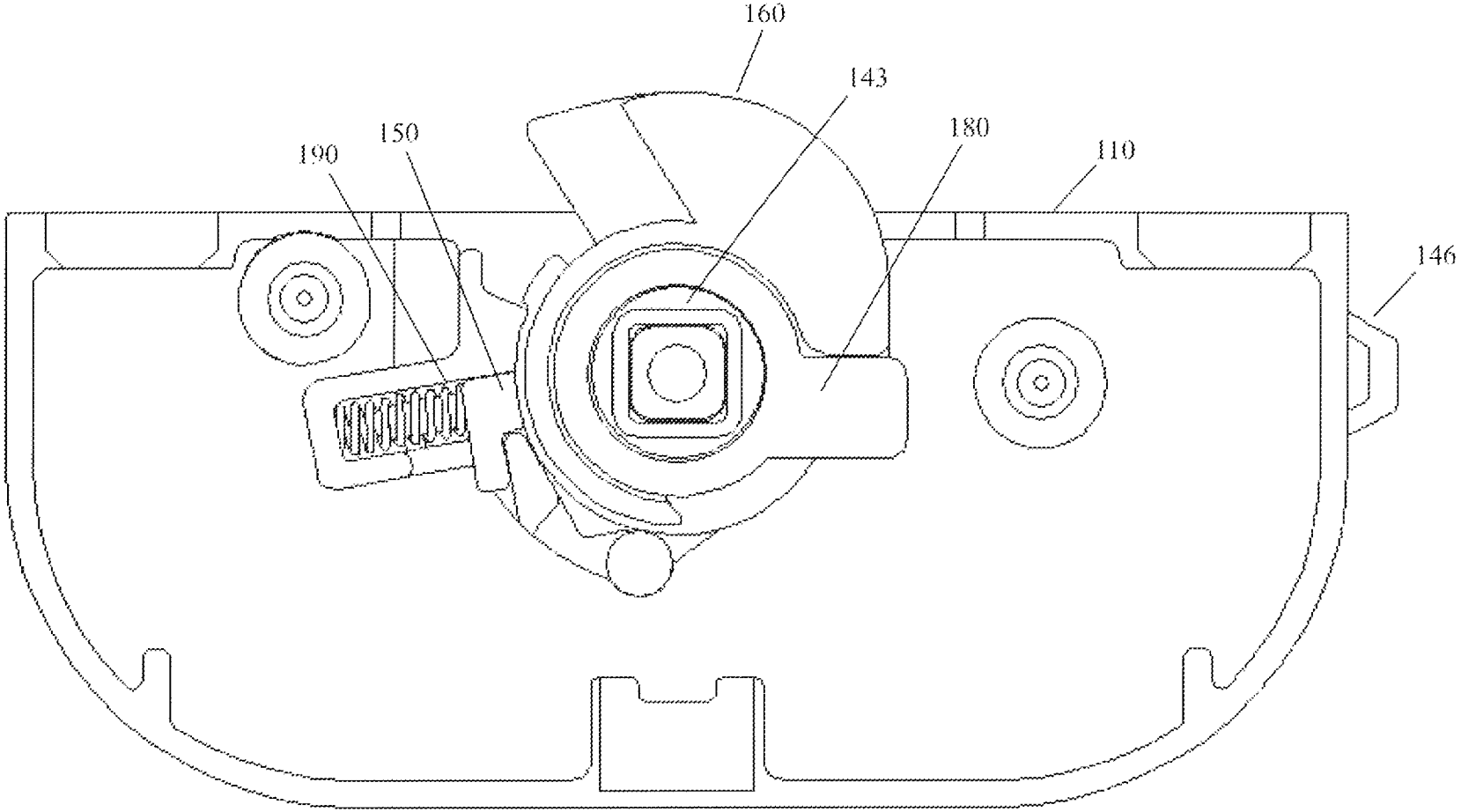
FIG. 55 is the bottom view of FIG. 54, but which also shows the plate member fixedly secured to the shaft within the housing cavity.

Assembly of the component parts shown in the exploded view of FIG. 1A is shown sequentially within FIGS. 47-55. In FIG. 47, the spring 190 is shown received onto the second portion 153 of plate member 150. In FIG. 48, the plate member 150 with the spring 190 received on its second portion 153 may be inserted into the recess 122 of the housing 110, to be as shown in FIG. 49 and FIG. 50. Next the cylindrical shaft 143 of the shaft/handle member 140 may be received into the hole 120 of housing 110, and may be clocked as shown in FIG. 51 and FIG. 52, which may result in the curved surface 152C of the plate member 150 being received within the recess 141 of the shaft/handle member 140. As shown within FIG. 53 and FIG. 54, the cam 160 may then be pivotally mounted to the shaft/handle member 140, with the hole 164 of the cam being received upon the shaft 143 of the shaft/handle member. The lever member 180 may then be fixedly secured to the shaft/handle member 140, with the rectangular shaped recess 184 of the lever member being received upon, the rectangular shaped protrusion 144 of a shaft/handle member, as shown in FIG. 55. The lever member 180 may be fixedly secured thereto using any attachment means known in the art, including, but no limited to, adhesive, mechanical fasteners, etc.

Being so assembled, the earn 160 is configured to be rotated, through rotation of the shaft/handle member 140, in a first direction out of the housing opening 144 into an extended position for the walls 165/166 to engage the keeper to lock the sash window(s) in the locked cam position, and may be seen in FIGS. 57-61.

Figure 57:
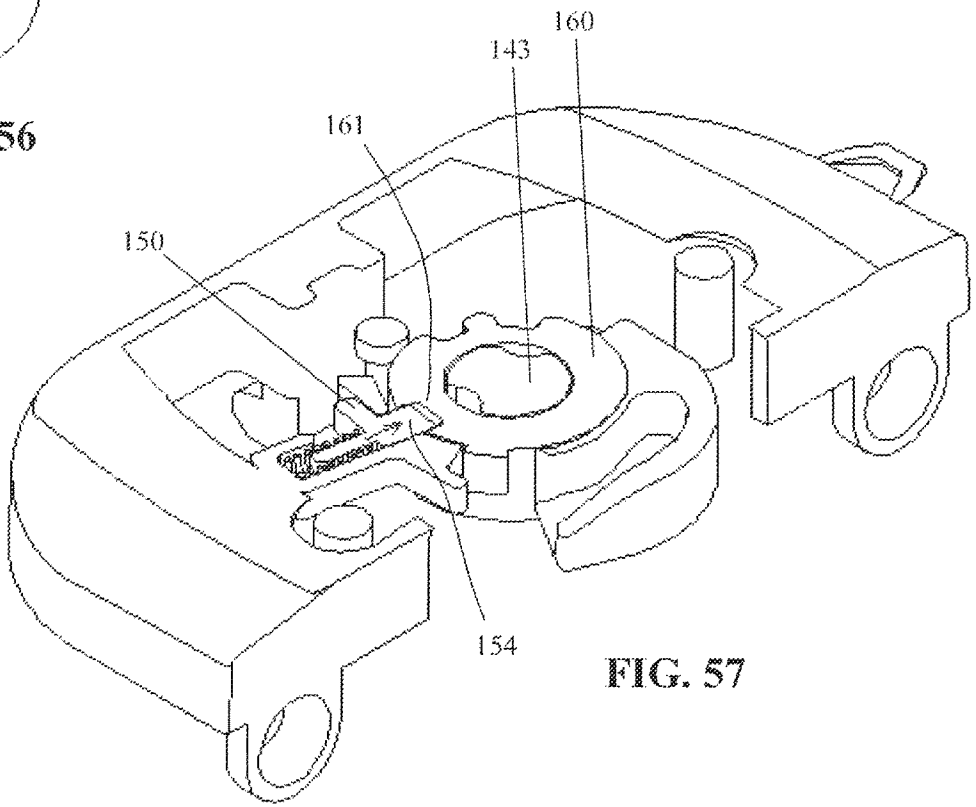
FIG. 57 is the top perspective view of the lock assembly, as shown in FIG. 56, but is shown with the top portion cut away further to expose the protrusion of the plate member engaged within the first shaped opening of the shaft, with the cam shown in the extended lock position.
Figure 58:
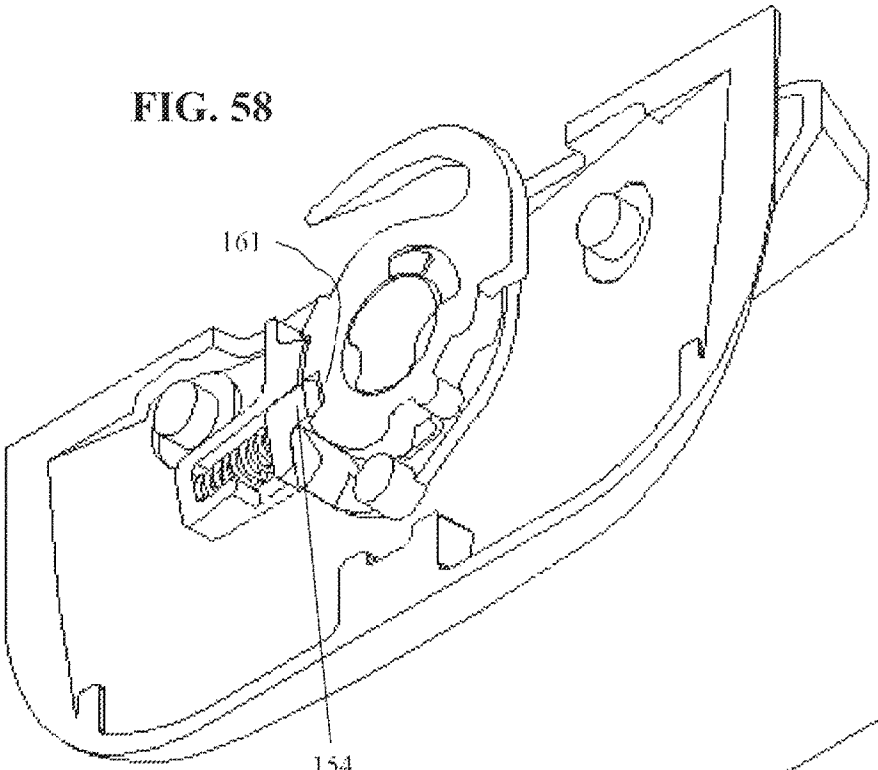
FIG. 58 is a bottom perspective view of the lock assembly shown with the bottom portion cutaway to expose the protrusion of the plate member engaged within the first shaped opening of the shaft, with the cam shown in the extended lock position.
Figure 59:
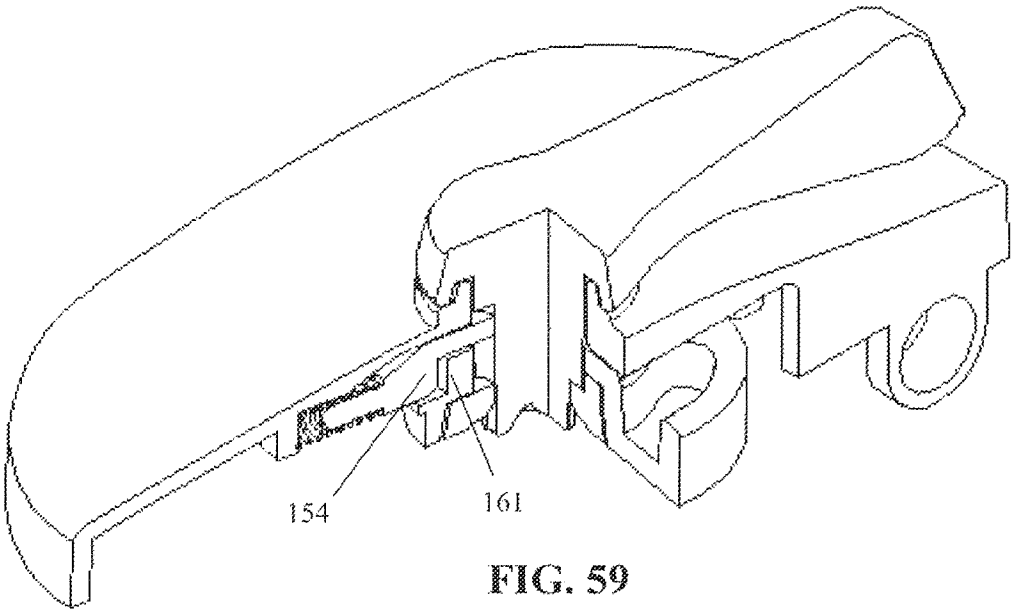
FIG. 59 is the top perspective view of the lock assembly, but is shown with one-quarter of the lock assembly cutaway to expose the protrusion of the plate member engaged within the first shaped opening of the shaft, with the cam shown in the extended lock position.
Figures 60, 61:
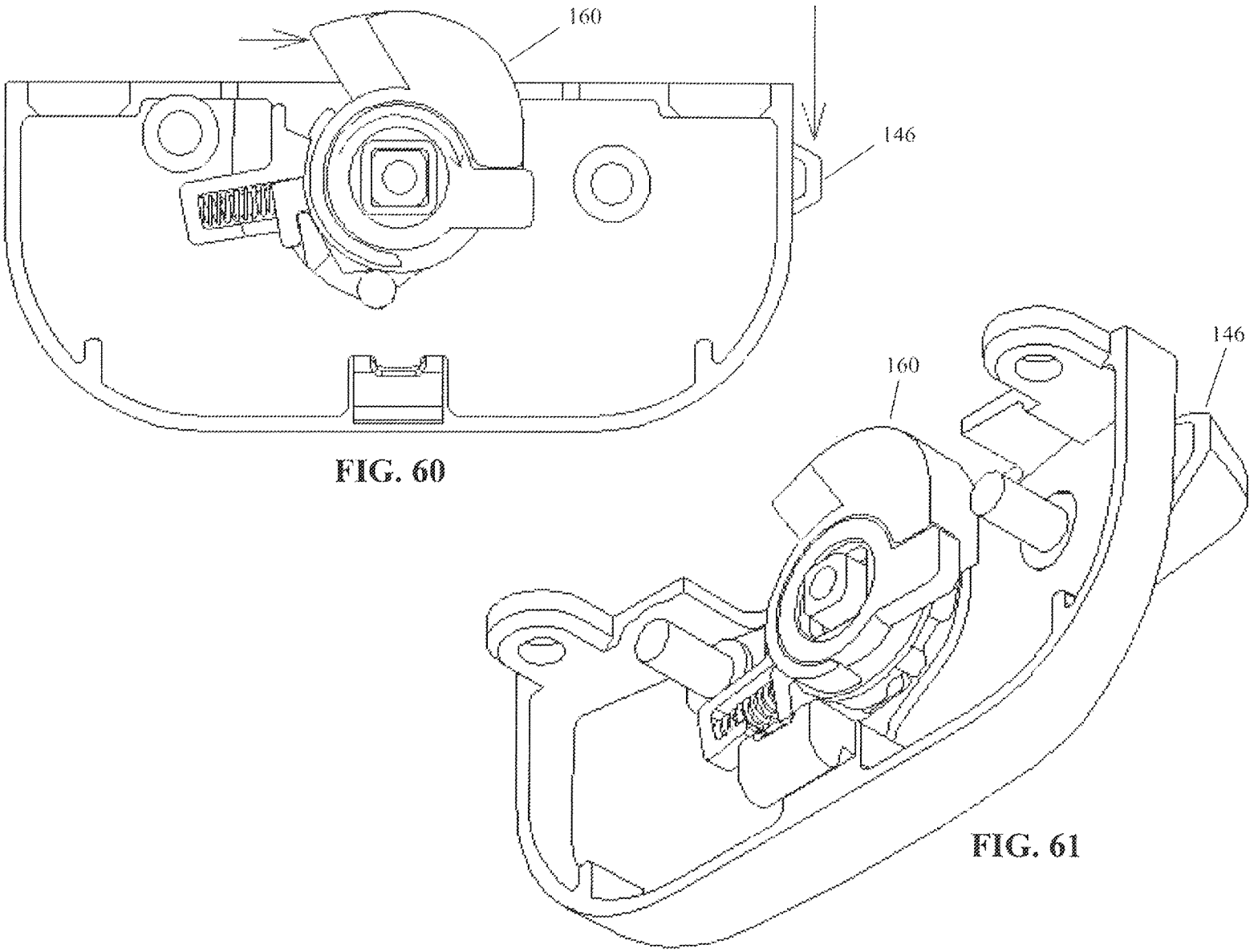
FIG. 60 is the bottom view of the sash lock, as shown in FIG. 55, but is also shown with an arrow indicating application of an actuation force applied to the handle, and a second arrow indicating an initial direction of movement of the exposed portion of the cam.
FIG. 61 is a perspective view of the sash lock, as shown in FIG. 60.

As seen therein, with the cam 160 in the locked (extended) position, the compression spring 190 biases the plate member 150 for its curved surface 153C to be aligned and engaged with the first recess 141 of the shall 143 of the shaft/handle member 140 (FIG. 56), and for protrusion 154 of the plate member 150 to be to be received within the first shaped opening 161 of the earn 160 (FIG. 57).

Figure 62:
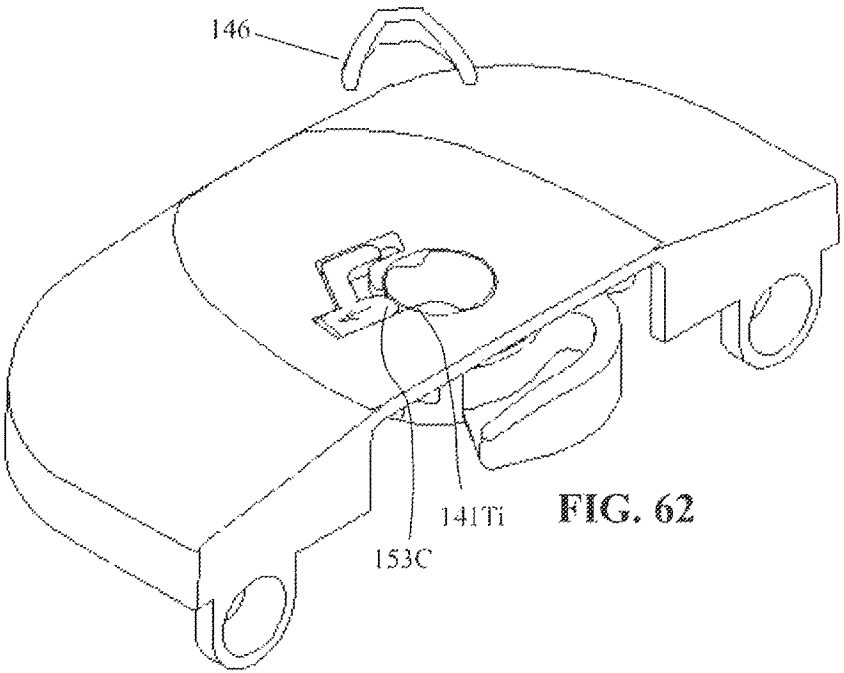
FIG. 62 is the top perspective view of FIG. 56, but is shown with the handle having been rotated for the curved surface of the plate member having just been rotated sufficiently to be disengaged from the first curved recess of the shaft.
Figure 63:
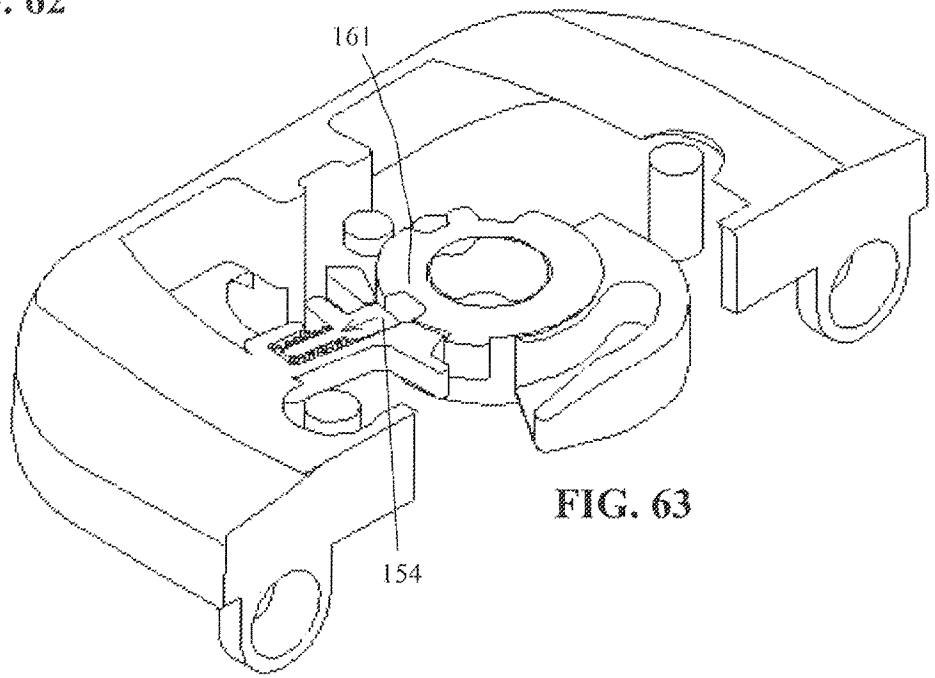
FIG. 63 is the top perspective view of the lock assembly, as shown in FIG. 62, but is shown with the top portion cut away further to expose the protrusion of the plate member disengaged from the first shaped opening of the shaft.
Figure 64:
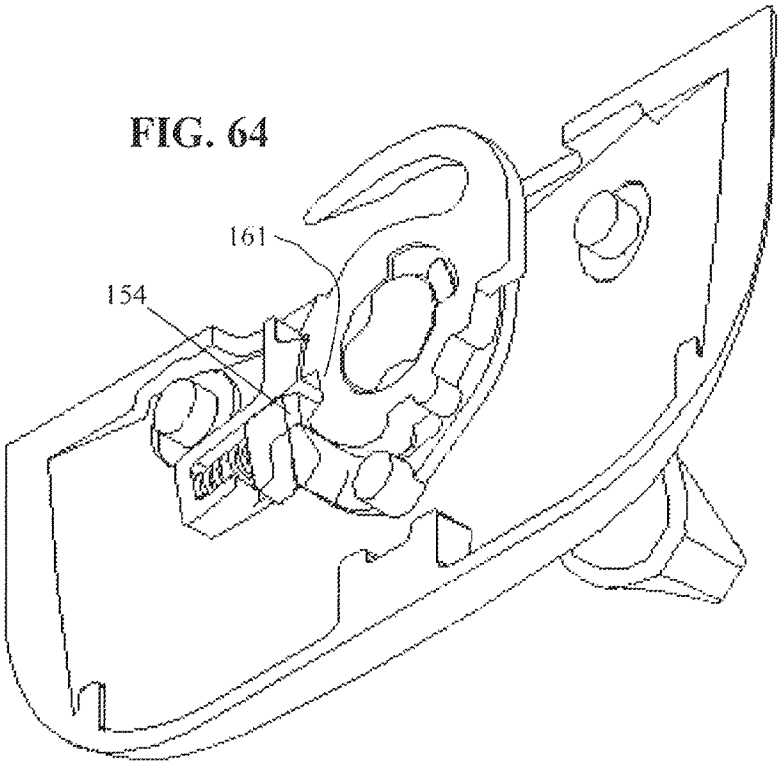
FIG. 64 is the cut-away bottom perspective view of FIG. 58, but is shown with the handle having been rotated as for FIG. 62, for the curved surface of the plate member to be disengaged from the first curved recess of the shaft.
Figure 65:
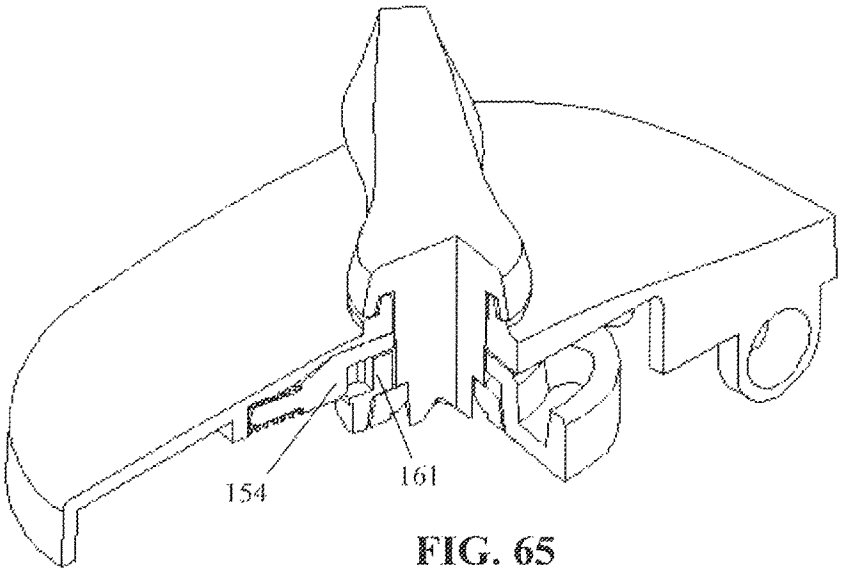
FIG. 65 is the top perspective view of the lock assembly, with the shaft and handle as positioned as in FIG. 62 and FIG. 63, but is shown with one-quarter of the lock assembly cutaway to expose the protrusion of the plate member engaged within the first shaped opening of the shaft.
Figures 66, 67:
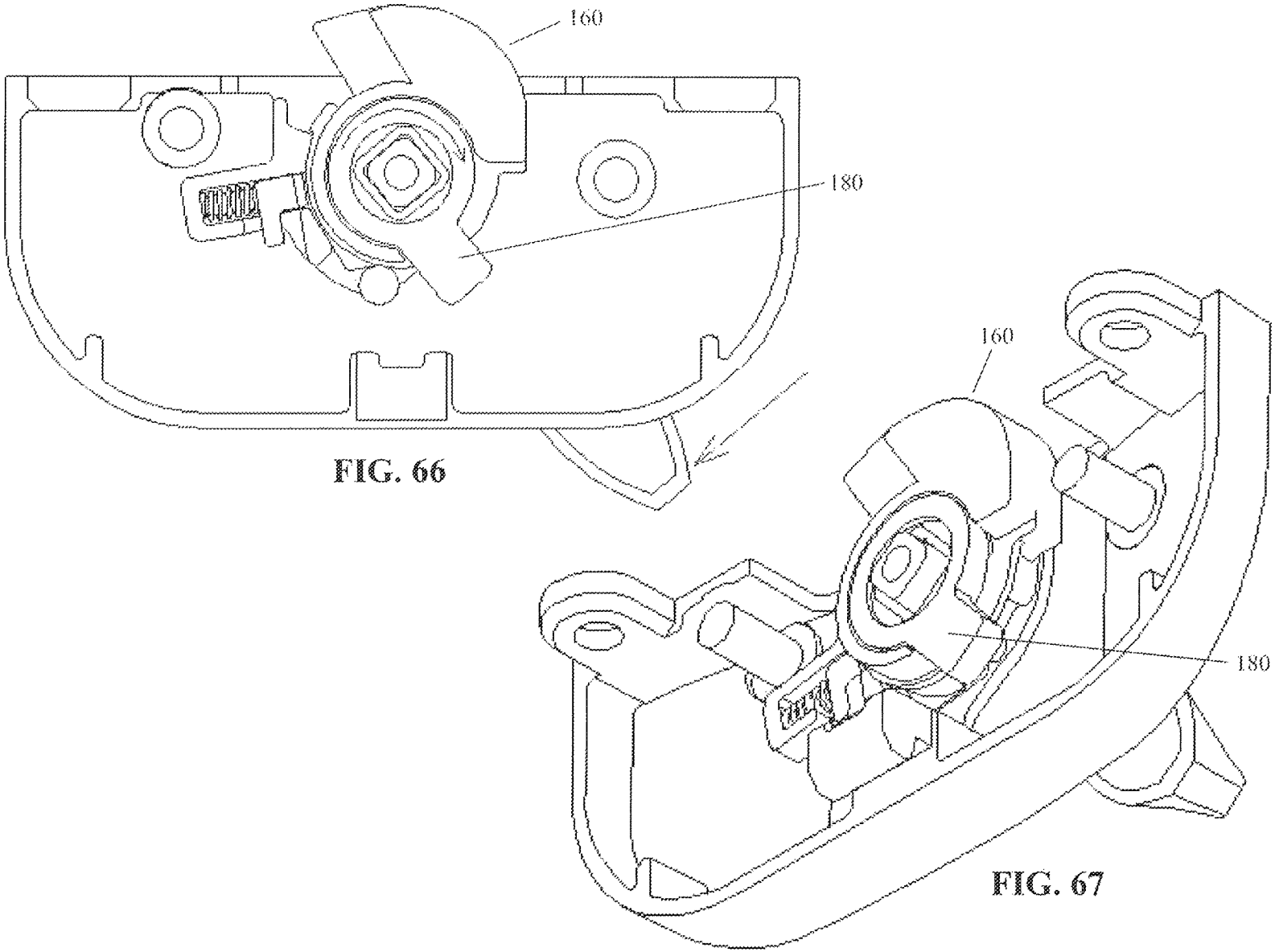
FIG. 66 is the bottom view of FIG. 60, but is shown with the shaft and handle rotated roughly 50 degrees, with corresponding rotation of the plate member, for the protrusion of the plate member to initially contact a first end of an arcuate recess in the cam, to begin to drive the cam to co-rotate in a first direction, to begin retraction of the cam into the housing cavity towards the retracted cam position.
FIG. 67 is a bottom perspective view of the sash lock, with the shaft and handle shown positioned the same as in FIG. 66.

With the cam 160 in the locked (extended) position, upon rotation of the shaft in the second direction (see arrows in FIGS. 60-61), in order to retract the cam within the housing cavity to unlock the sash windows, the first transition surface 141Ti of the shaft 143 of the shaft/handle member 140 contacts the curved surface 153C of the plate member 153 and acts as a cam surface to oppose the spring; bias and drive the plate member to slide within the housing recess 122 (FIG. 62). This causes the protrusion 154 of the plate member 150 to be withdrawn from the first shaped opening 161 of the cam 160 (FIG. 63), and the cam 160 is then unlatched.

Figure 68:
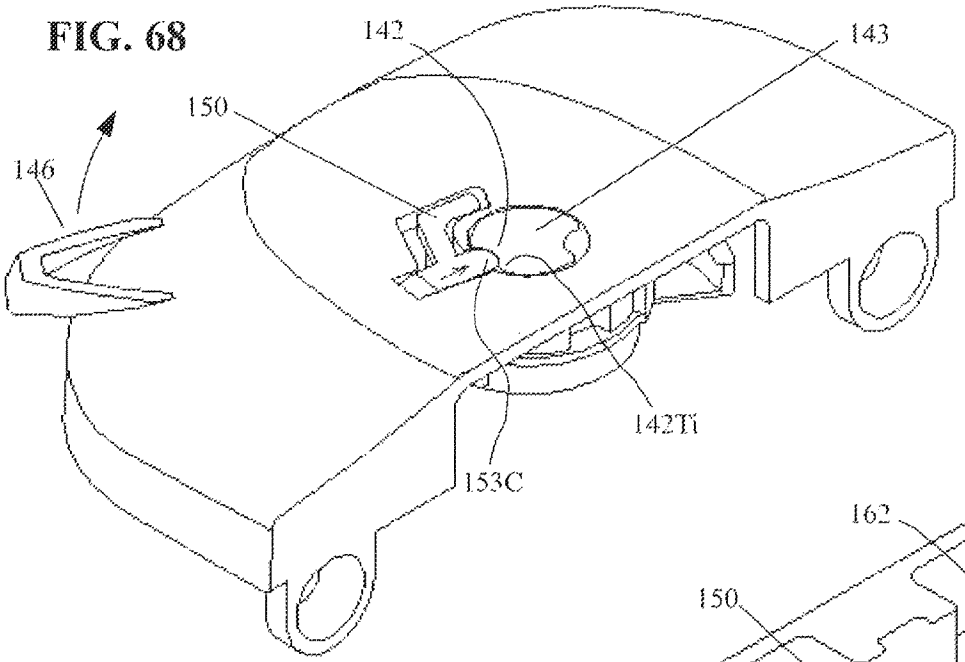
FIG. 68 is the cutaway top perspective view of FIG. 62, but is shown with the handle having been rotated roughly 140 degrees for the curved surface of the plate member to become engaged with the second curved recess of the shaft, with the cam then positioned in the unlocked (retracted) position.

Once the shaft/handle member 140 has been rotated the requisite amount (e.g., 50 degrees), the first side 187*i* of the protrusion. 187 of the lever member 180 contacts the first end 167*i* of the arcuate recess 167 in the cam 160, and drives the cam to co-rotate. The co-rotation may continue until the cam 160 has been retracted within the housing cavity to unlock the sash window(s). As noted hereinabove, the shaft rotation may continue, until the protrusion 169 on the cam 160 contacts the corresponding housing stop feature (FIG. 70) to limit such rotation. When the shaft/handle member 140 has driven the cam 160 into the retraction-limited position, the curved surface 153C of the plate member 153 may become aligned with and received within the second recess 142 of the shaft 143 of the shaft/handle member 140 as seen in FIG. 68. Upon being biased into such contact, the protrusion 154 of the plate member extends to be received within the second shaped opening 162 of the cam 160 (FIG. 63), and the cam is once again latched, while positioned at the unlocked (retracted) position. Note—in an alternate embodiment, the second shaped opening 162 of the cam 160 may instead be an enlarged, over-sized open area, so that cam does not latch in the unlocked (retracted) position, only the locked (extended) position.

Figure 72:
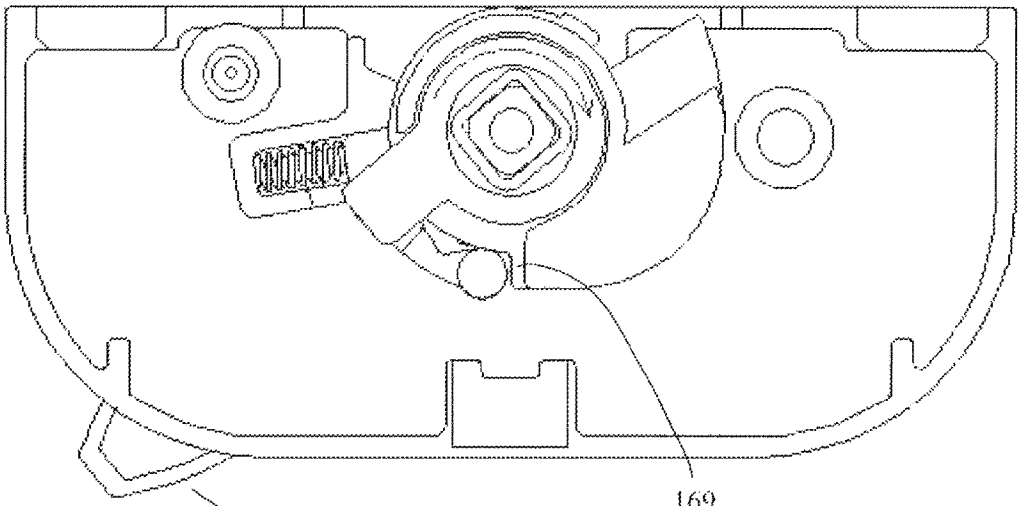
FIG. 72 is the bottom view of FIG. 60, but is shown with the handle having been rotated roughly 140 degrees for the curved surface of the plate member to become engaged with the second, curved recess of the shaft, with the cam then positioned in the retracted unlock position.
Figure 73:
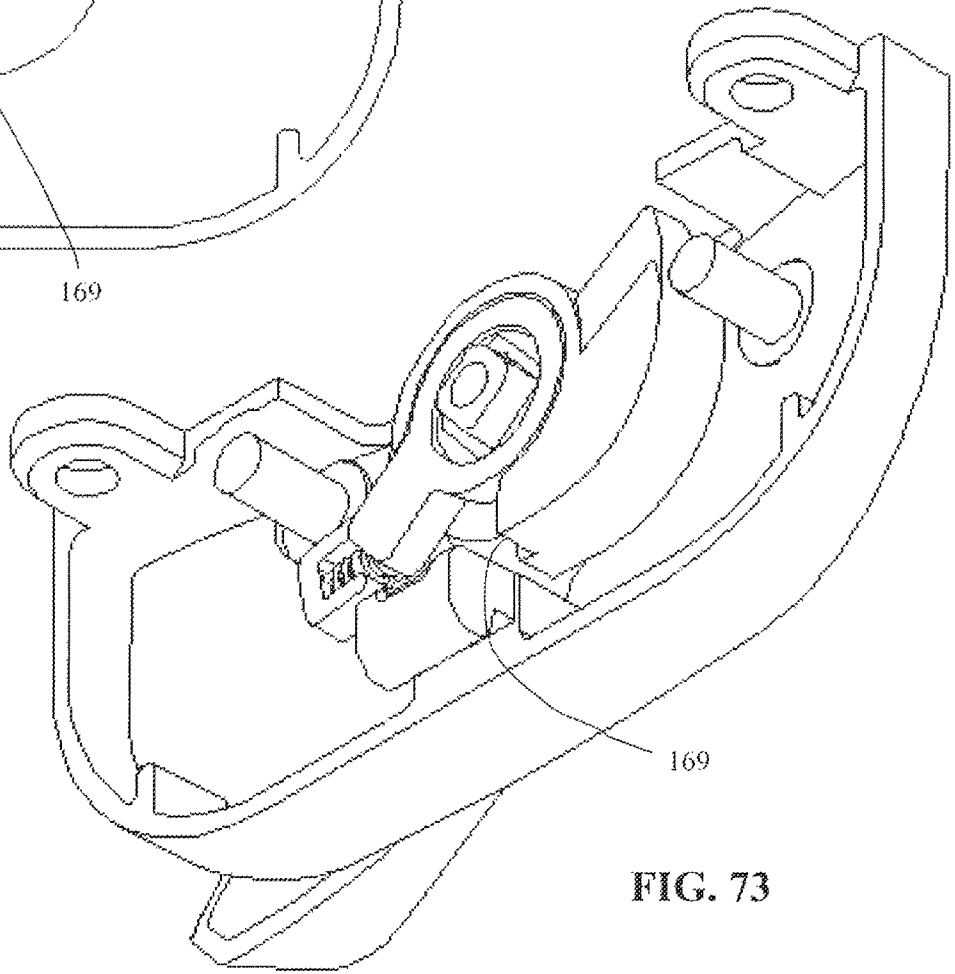
FIG. 73 is a bottom perspective view of the sash lock, with the shaft and handle shown positioned the same as in FIG. 72.
Figure 74:
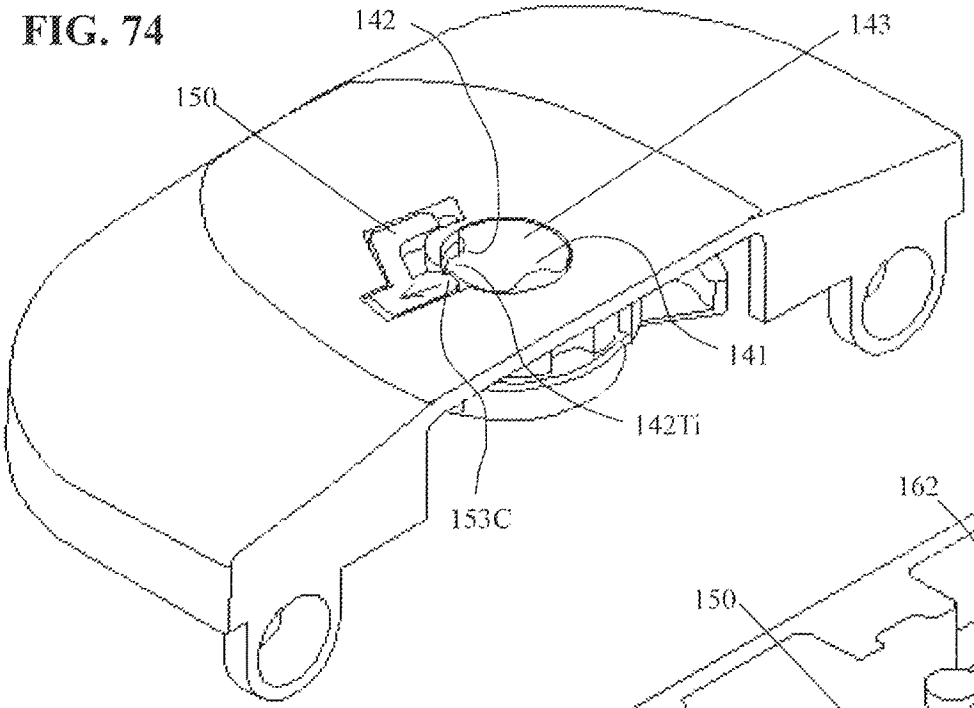
FIG. 74 is the cutaway top perspective view of FIG. 68, but is shown with the handle having been counter-rotated roughly 50 degrees for the curved surface of the plate member to become disengaged from the second curved recess of the shaft, with the cam still positioned in the retracted unlock position.
Figure 75:
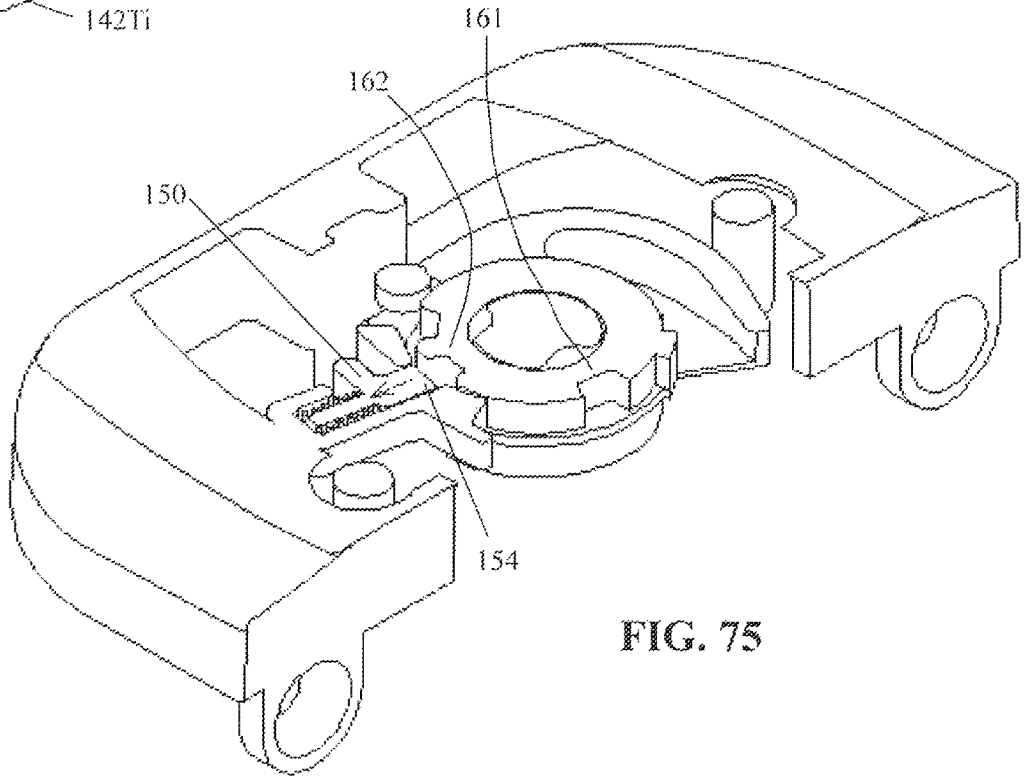
FIG. 75 is the cutaway top perspective view of FIG. 69, but is shown with the handle having been counter-rotated roughly 50 degrees for the protrusion of the plate member to become disengaged from the second shaped opening of the shaft, with the cam still positioned in the retracted unlock position.
Figure 76:
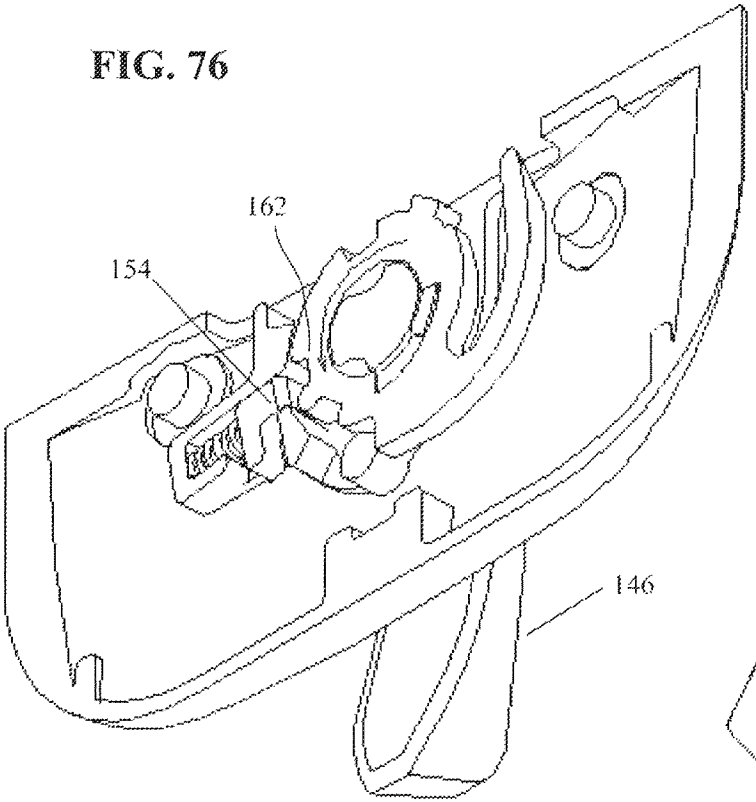
FIG. 76 is the cutaway bottom perspective view of FIG. 70, but is shown with the handle having been counter-rotated roughly 50 degrees for the protrusion of the plate member to become disengaged from the second shaped opening of the shaft, with the cam still positioned in the retracted unlock position.
Figure 77:
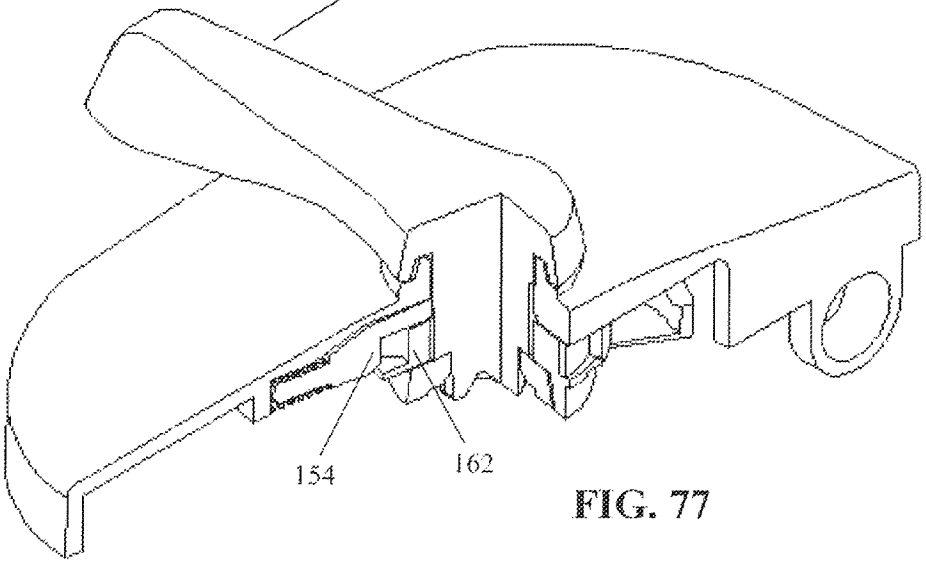
FIG. 77 is the cutaway bottom perspective view of FIG. 71, but is shown with the handle having been counter-rotated roughly 50 degrees for the protrusion of the plate member to become disengaged from the second shaped opening of the shaft, with the cam still positioned in the retracted unlock position.

With the cam 160 in the unlocked (retracted) position, upon rotation of the shaft in the first direction (see arrow in FIG. 72), in order to extend the cam out from the housing cavity to lock the sash windows, the transition, surface 142Ti of the shaft 143 of the shaft/handle member 140 contacts the curved surface 153C of the plate member 153 (see FIG. 68 and FIG. 74) and again acts as a cam surface to oppose the spring bias and drive the plate member to slide within the housing recess 122. This causes the protrusion 154 of the plate member ISO to be withdrawn from the second shaped opening 162 of the cam 160 (FIG. 75), and the cam is again unlatched.

Figures 78, 79:
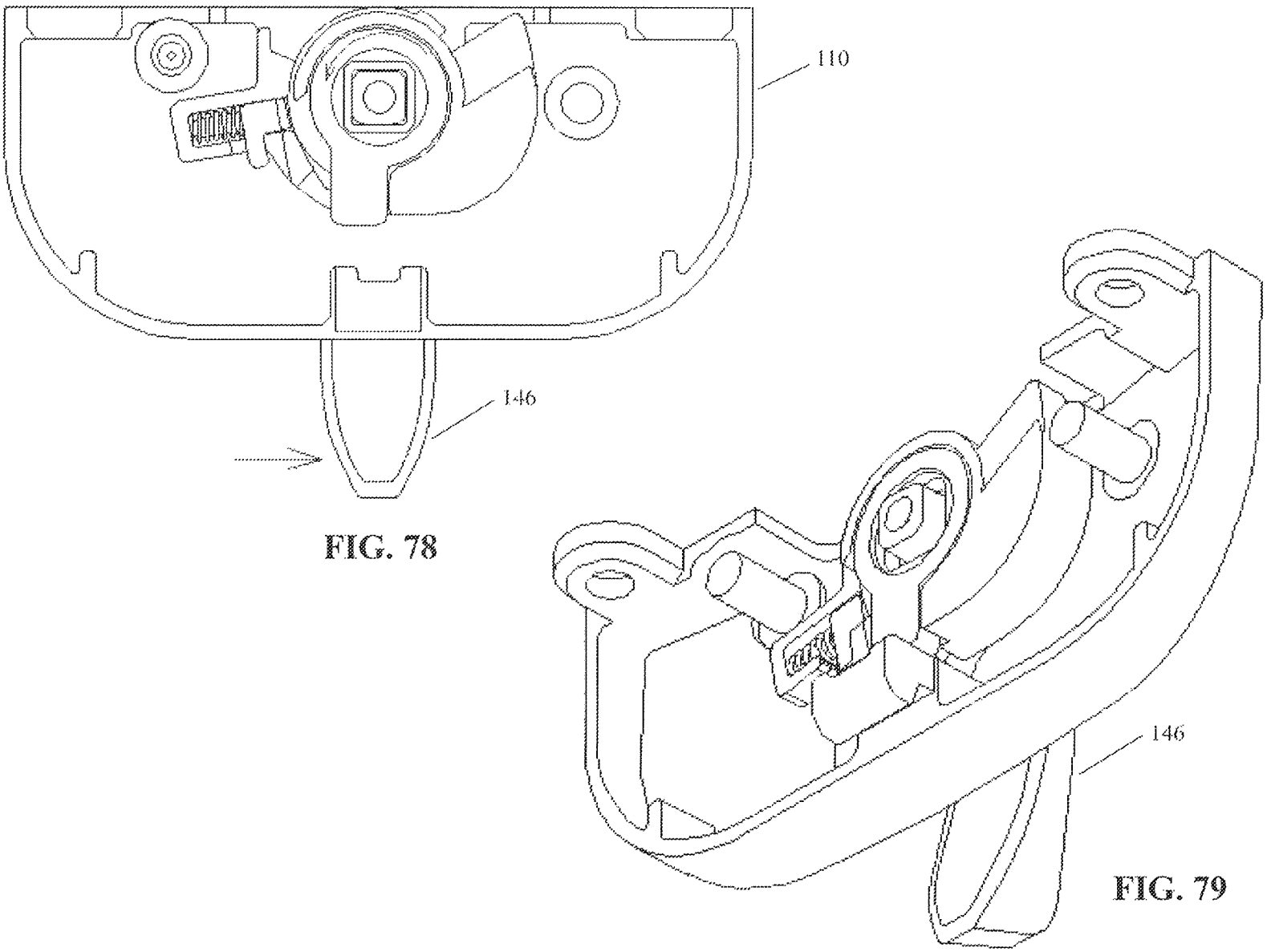
FIG. 78 is the bottom view of FIG. 72, but is shown with the handle having been counter-rotated roughly 50 degrees, for the protrusion of the plate member to initially contact a second end of the arcuate recess in the cam, to begin to drive the cam to co-rotate in a second direction, to begin extending the cam out from the housing cavity towards the locked (extended) position.
FIG. 79 is a bottom perspective view of the sash lock, with the shaft and handle shown positioned the same as in FIG. 78.

Once the shaft/handle member 140 has been further rotated in the first direction the requisite amount (e.g., 50 degrees—see FIGS. 78-79), the second side 187*ii* of the protrusion 187 of the lever member 180 may contact the second end 167*ii* of the arcuate recess 167 in the cam 160, and may again drive the cam to co-rotate. The co-rotation may continue until the earn 160 has been extended out from the housing cavity for the walls 165/166 of the cam 160 to engage the keeper and lock the sash window(s), which may limit rotation of the cam. Also, the co-rotation may be limited by the protrusion 168 on the cam 160 contacting the corresponding housing stop feature (FIG. 53) to limit such rotation. When the shaft/handle member 140 has driven the cam 160 into the extension-limited position, the curved surface 153C of the plate member 153 may once again become aligned with and received within the first recess 141 of the shaft 143 of the shaft/handle member 140, as seen in FIG. 56. Upon being biased into such contact, the protrusion 154 of the plate member may simultaneously extend to be received within the first shaped opening 161 of the cam 160 (FIG. 57), and the cam is once again latched.

While illustrative implementations of one or more embodiments of the present invention are provided hereinabove, those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the exemplary embodiments without departing from the spirit of this invention.

Accordingly, the breadth and scope, of the present disclosure should not be limited by any of the above-described example embodiments, but should be defined only in accordance with the following claims and their equivalents.

What is claimed is:

1. A tamper-resistant sash window lock comprising:

a housing, said housing comprising: a wall shaped to form an interior surface that defines a cavity; an orifice interconnected with said cavity; and an elongated recess formed in said interior surface of said wall;

at shaft rotatably mounted in said housing orifice and comprising: a first curved recess, and a second curved recess;

a cam pivotally mounted to said shaft within said housing cavity, and comprising a first shaped opening and a second shaped opening at first and second respective positions, and an arcuate recess;

a lever member fixedly secured to said shaft, and comprising: a protrusion configured to alternately engage each of first end and a second end of said arcuate recess to respectively drive said cam in each of a first direction and a second direction, respectively;

a compression spring;

a plate member comprising: a first portion configured to be slidably received within said elongated recess of said housing, a first end of said first portion of said plate member formed into a curved surface shaped to correspond to each of said first and second curved recesses; a second portion configured to extend from said first portion of said plate member, and to slidably receive said compression spring thereon; and a protrusion shaped to be alternately received within said first shaped opening and said second shaped opening of said cam; and wherein said compression spring biases said plate member for said protrusion of said plate member to be respectively received within each of said first shaped opening and said second shaped opening of said cam, when rotated to be aligned therewith, and for said curved surface of said plate member to be correspondingly received within said first curved recess and said second curved recess, respectively, when rotated to be aligned therewith, at a locked cam position and an unlocked cam position.

2. The tamper-resistant sash window lock according to claim 1 wherein upon rotation of said shaft in a first direction, with said cam retracted within said housing at said unlocked cam position, said first curved recess of said shaft engages said curved surface of said plate member to oppose said spring bias to cause said protrusion of said plate member to be withdrawn from said first shaped opening of said cam, to permit said cam to be driven by said protrusion of said lever member in said first direction to said locked corn position.

3. The tamper-resistant lock according to claim 2 wherein upon rotation of said shaft in said second direction, with a portion of said cam extended out said housing in said locked cam position, said second curved recess of said shaft engages said curved surface of said plate member to oppose said spring bias to cause said protrusion of said plate member to be withdrawn from said second shaped opening of said cam, to permit said cam to be driven by said protrusion of said lever member in said second direction to said unlocked earn position.

4. The tamper-resistant sash window lock according to claim 3 wherein said curved surface comprises a portion of a cylindrical surface.

5. The tamper-resistant lock according to claim 3 wherein said curved surface comprises a portion of a spherical surface.

6. The tamper-resistant sash window lock according to claim 3 wherein said arcuate recess in said cam is configured for said lever member to rotate 50 degrees from said locked cam position in said second direction before said cam is driven by said lever member to co-rotate in said second direction.

7. The tamper-resistant sash window lock according to claim 6 wherein said cam and said lever member are configured for said shaft to rotate 140 degrees for said cam to be driven from said locked cam position to said unlocked cam position.

8. The tamper-resistant sash window lock according to claim 7 wherein said cam and said lever member are configured for said shaft to rotate 50 degrees from said unlocked cam position in said first direction before said cam is driven by said lever member to co-rotate in said first direction.

* * * * *